US006562535B1

(12) United States Patent
Masuo et al.

(10) Patent No.: US 6,562,535 B1
(45) Date of Patent: May 13, 2003

(54) TONER FOR DEVELOPMENT OF ELECTROSTATIC IMAGE

(75) Inventors: Kojiro Masuo, Kanagawa (JP); Shuichi Yokoyama, Kanagawa (JP); Takuji Kishimoto, Kanagawa (JP); Kazu Niwa, Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/937,476

(22) PCT Filed: Mar. 27, 2000

(86) PCT No.: PCT/JP00/01848

§ 371 (c)(1),
(2), (4) Date: Sep. 25, 2001

(87) PCT Pub. No.: WO00/58790

PCT Pub. Date: Oct. 5, 2000

(30) Foreign Application Priority Data

Mar. 26, 1999 (JP) ..... 11/084828
Oct. 15, 1999 (JP) ..... 11/293236

(51) Int. Cl.[7] ..... G03G 9/097

(52) U.S. Cl. ..... 430/108.22; 430/108.5; 430/137.17

(58) Field of Search ..... 430/108.22, 137.17

(56) References Cited

U.S. PATENT DOCUMENTS

| | | | | |
|---|---|---|---|---|
| 5,294,490 A | | 3/1994 | Sasaki et al. | 428/402.21 |
| 5,858,600 A | * | 1/1999 | Itakura et al. | 430/137 |
| 5,958,640 A | | 9/1999 | Hasegawa et al. | 430/109 |
| 6,033,822 A | | 3/2000 | Hasegawa et al. | 430/137 |
| 6,399,264 B1 | * | 1/2002 | Ogata et al. | 430/120 |

FOREIGN PATENT DOCUMENTS

| | | |
|---|---|---|
| EP | 07836122 | 4/1998 |
| JP | 01-204060 | 8/1989 |
| JP | 01-217464 | 8/1989 |
| JP | 03-015858 | 1/1991 |
| JP | 03-175456 | 7/1991 |
| JP | 03-243954 | 10/1991 |
| JP | 04-195166 | 7/1992 |
| JP | 05-249745 | 9/1993 |
| JP | 06-161156 | 6/1994 |
| JP | 09-204073 | 8/1997 |
| JP | 09-292739 | 11/1997 |
| JP | 11-174738 | 7/1999 |
| JP | 11-242352 | 9/1999 |
| JP | 11-258848 | 9/1999 |
| JP | 11-282212 | 10/1999 |

* cited by examiner

*Primary Examiner*—John Goodrow
(74) *Attorney, Agent, or Firm*—Dinsmore & Shohl LLP

(57) ABSTRACT

A toner for development of electrostatic images, comprising at least a binder resin, a colorant and a charge control agent, wherein the charge control agent contains a positive charge control resin (A) composed of a polymer having a weight average molecular weight of 1,000 to 100,000 and a functional group which brings positively charging ability, and a negative charge control resin (B) composed of a polymer having a weight average molecular weight of 1,000 to 100,000 and a functional group which brings negatively charging ability. The toner is excellent in flowability, shelf stability and charge properties, and provides images excellent in image quality.

20 Claims, No Drawings

TONER FOR DEVELOPMENT OF ELECTROSTATIC IMAGE

TECHNICAL FIELD

The present invention relates to a toner for development of electrostatic images for developing electrostatic latent images formed on a photosensitive member by an electrophotographic process, electrostatic recording process or the like, and more particularly to a toner for development of electrostatic images, which is sharp in particle diameter distribution, excellent in flowability and shelf stability, small in dependence of charge level on environment and little in deterioration of image quality by continuous printing.

BACKGROUND ART

In an image forming apparatus such as an electrophotographic apparatus or electrostatic recording apparatus, an electrostatic latent image (electrostatic image) is formed on a photosensitive member uniformly and evenly charged by exposure to a light pattern of the image, and a developer is applied to the exposed region or unexposed region on the photosensitive member to conduct development. The developer image formed on the photosensitive member is generally transferred to a transfer medium such as paper or OHP film, and the unfixed image is then fixed to the transfer medium by a method such as heating, pressing or use of solvent vapor. As the developer, is used a toner composed of colored particles comprising a binder resin in which a colorant and various kinds of additives such as a charge control agent and a parting agent have been dispersed.

As toners for development of electrostatic images, ground toners obtained by melting and mixing a colorant and a charge control agent, and optionally various kinds of additives such as a parting agent in a thermoplastic resin to prepare a resin composition and then grinding and classifying the resin composition have heretofore been used mainly. In recent years, polymerized toners easy to control their particle diameter and permitting omitting complicated production steps such as grinding and classification have come to attract attention. In any toner, a charge control agent is generally contained in order to make the toner have charge properties.

In general, a polymerized toner is produced by pouring a polymerizable monomer composition containing a polymerizable monomer, a colorant, a charge control agent and the like in an aqueous dispersion medium containing a dispersion stabilizer to disperse it in the aqueous medium by means of a mixer having high shearing force, thereby forming fine droplets of the monomer composition, and then subjecting the dispersion containing the fine droplets to suspension polymerization. A polymer formed by the polymerization of the polymerizable monomer becomes a binder resin, and the additives such as the colorant are dispersed therein. In the polymerization process of such a polymerized toner, it is extremely important from the viewpoint of properties of the resulting toner to uniformly disperse the additives such as the colorant and charge control agent in the polymerizable monomer, and to stably form the fine droplets of the monomer composition in the aqueous dispersion medium.

However, the colorant such as carbon black is generally high in hydrophilicity and hence difficult to uniformly disperse in the polymerizable monomer. When the dispersion of the colorant is insufficient, the colorant becomes unevenly distributed on the surfaces of the droplets of the monomer composition due to its high hydrophilicity, and the droplet diameter distribution of the droplets also becomes broad. As a result, the flowability and developing ability of the resulting polymerized toner are deteriorated, and classification is required to lower the yield of the polymerized toner.

Further, since many of charge control agents such as nigrosine dyes which have heretofore been generally used are high in hydrophilicity like the colorant, they have involved such problems that the dispersibility of other components such as the colorant is inhibited, the stability of the droplets of the monomer composition in the aqueous dispersion medium is inhibited, and the blocking resistance of the resulting polymerized toner is adversely affected to lower the shelf stability thereof, in addition to its poor dispersibility.

In order to solve such problems, there is adopted a method in which in a process of forming droplets of a monomer composition in an aqueous dispersion medium, a suspension formed is vigorously stirred by means of a mixing device having high shearing force, or the like to finely disperse the droplets. However, it is difficult to sufficiently enhance the uniformly dispersing ability of the additives and the stability of the droplets by such process for forming the droplets. In addition, a toner to be produced is colored with a charge control agent itself such as a nigrosine dye or metallized dye. Therefore, such a charge control agent cannot be used as a charge control agent for color toners.

Various proposals have been made as to charge control agents used in place of the charge control agents such as nigrosine dyes. For example, Japanese Patent Application Laid-Open No. 175456/1991 discloses a production process of a polymerized toner, in which a colorant is dispersed in a polymerizable monomer in the presence of a copolymer of a styrene monomer and a quaternary ammonium salt group-containing acrylic ester, and the resultant dispersion is then subjected to suspension polymerization, and describes the resultant polymerized toner as being sharp in particle diameter distribution and also excellent in moisture absorption resistance. The quaternary ammonium salt group-containing copolymer is a charge control agent having positively charging ability. In addition, Japanese Patent Application Laid-Open Nos. 217464/1989, 15858/1991 and 243954/1991 disclose a polymerized toner containing a charge control agent having negatively charging ability composed of a sulfonic group-containing copolymer.

When such a charge control resin having positively or negatively charging ability is used, the charge properties of the resulting toner is good in an initial stage of printing, and an image having high image quality free of fog is provided therefrom. In addition, the charge control resin is colorless and hence can be applied to color toners. However, the toner containing such a charge control agent does not have sufficiently stable charge properties, and so image density becomes thin in an early stage when conducting continuous printing. In addition, the toner containing the charge control resin has high dependence of image quality on environment, and it is hence difficult to retain sufficiently high quality under a high-temperature and high-humidity environment. Its tendency becomes strong in the case of continuous printing in particular. Further, when the charge control resin having negatively charging ability is used, flying-off of the resulting toner tends to occur by continuous printing.

Japanese Patent Application Laid-Open No. 195166/1992 has proposed a toner making combined use of a negatively charged charge control agent composed of a polymer comprising an acrylamide monomer having a sulfonic group-containing hydrocarbon group, and a charge control aid having a charge controlling action of an opposite polarity thereto and composed of a quaternary ammonium salt compound. According to this publication, it has been reported that when the negatively charged charge control agent and the charge control aid composed of the quaternary ammonium salt compound are used in combination, the charge distribution of the resulting toner becomes sharp when it is used as a magnetic two-component developer. The toners specifically shown in this publication are free of fogging and flying-off of toner and achieve image quality high in image density in printing up to 1,000 sheets, and is sharp in charge distribution even after printing of 10,000 sheets. However, the image quality after the printing of 10,000 sheets is greatly lowered compared with the image quality at the time printing was conducted on 1,000 sheets. In recent developing apparatus that conduct printing on paper as many as 20 sheets per minute, this tendency becomes stronger, since there are changes in development conditions such as the lowering of fixing temperature.

As described above, the toners making use of the charge control agent having the positively or negatively charging ability as a charge control agent has been difficult to fully meet the requirements such as flowability, shelf stability, charge stability, retention of high image quality in continuous printing and lowering of dependence of image quality on environment. In addition, the level of requirements for enhancement of the properties of toners in recent years has been raised from the viewpoint of speeding-up of printing, formation of full-color images and energy saving by lowering a fixing temperature. However, the toners making use of the conventional charge control agents have not been able to fully meet these requirements. Further, it has been necessary to bring the form of a toner close to a true sphere and make the average particle diameter thereof small according to a rise in requirement for high definition of images. However, such various problems as described above, including unevenness of dispersion of the charge control agent and the like and unevenness of the particle diameter distribution becomes more marked as the average particle diameter of the toner is made smaller.

DISCLOSURE OF THE INVENTION

It is an object of the present invention to provide a toner for development of electrostatic images, which is sharp in particle diameter distribution and excellent in flowability and shelf stability, scarcely changed even in charge properties in both environments of low-temperature and low-humidity, and high-temperature and high-humidity, and prevented from deterioration of image quality even when conducting continuous printing. Another object of the present invention is to provide a toner for development of electrostatic images, which can meat the lowering of a fixing temperature, the speeding-up of printing, the formation of full-color images, and the like and exhibits high resolution.

The present inventors have carried out an extensive investigation with a view toward achieving the above-described objects. As a result, it has been surprisingly found that the above objects can be achieved by containing, in combination, a charge control resin (positive charge control resin) for imparting a positively charging ability to the resulting toner and a charge control resin (negative charge control resin) for imparting a negatively charging ability to the resulting toner in a toner. More specifically, when the positive charge control resin and the negative charge control resin are used in combination, the stability of droplets of a monomer composition in an aqueous suspension medium is improved, the droplet diameter distribution of the droplets becomes sharp, and a toner excellent in various properties though its average particle diameter is small can be provided. The resultant toner can meet the speeding-up of printing, continuous printing, the formation of color images, and the like, and is excellent in shelf stability and small in dependence of image quality on environment. When the toner is provided in the form of a core-shell structure, or its average particle diameter is made smaller, the fixing temperature thereof can be made lower, and the image quality of the resulting image can be made higher definition. The charged polarity and charge level of the toner can be easily controlled by adjusting proportions of the positive charge control resin and negative charge control resin used, particularly a functional group ratio between the resins. The present invention has been led to completion on the basis of these findings.

According to the present invention, there is thus provided a toner for development of electrostatic images, comprising at least a binder resin, a colorant and a charge control agent, wherein the charge control agent contains a positive charge control resin (A) composed of a polymer having a weight average molecular weight of 1,000 to 100,000 and a functional group which brings positively charging ability, and a negative charge control resin (B) composed of a polymer having a weight average molecular weight of 1,000 to 100,000 and a functional group which brings negatively charging ability.

BEST MODE FOR CARRYING OUT THE INVENTION

Charge Control Agent (1) Positive Charge Control Resin:

The positive charge control resin (A) used in the present invention is a polymer having a weight average molecular weight of 1,000 to 100,000 and a functional group which brings positively charging ability. This polymer may be either a homopolymer or a copolymer so far as said functional group is bonded to any of its structure units. In general, the positive charge control resin is preferably a copolymer of a vinyl monomer having a functional group which brings positively charging ability, and another vinyl monomer copolymerizable therewith. However, it may be a polymer obtained by polymerizing a vinyl monomer having no functional group and then introducing the functional group into the resultant polymer by a modification treatment. A copolymer containing a monomer unit having a functional group which brings positively charging ability, a vinyl aromatic hydrocarbon monomer unit and a (meth) acrylate monomer unit is particularly preferred from the viewpoint of compatibility with a binder resin. When the positive charge control resin is compatible with a binder resin (polymer of a polymerizable monomer) in a toner, the charge properties of the toner becomes evener. The positive charge control resin is preferably soluble in a styrene monomer from the viewpoint of its dispersibility in a polymerizable monomer composition.

Examples of the functional group which brings positively charging ability include a pyridinium group, an amino group, a quaternary ammonium salt group, etc. Of these, the ammonium salt group is particularly preferred in that it effectively functions even in a non-magnetic one-component developer. A positive charge control resin having a quaternary ammonium salt group has an ionic structure represented by $—NR_3^+.X^-$. Three Rs are, independently of one another, a hydrogen atom or a substituent group such as an alkyl group, and X is a halogen atom, a halogenated alkyl group or a hydrocarbon group (alkyl group, aromatic hydrocarbon group, substituted aromatic hydrocarbon group or the like) having $—SO_3^-$, $—PO_3^-$ or $—BO_3^-$.

The weight average molecular weight (Mw) of the positive charge control resin is 1,000 to 100,000, preferably 2,000 to 50,000, more preferably 3,000 to 30,000. If the weight average molecular weight of the positive charge control resin is too high, the droplet diameter distribution of droplets of a monomer composition in an aqueous dispersion medium becomes broad. Further, if the weight average molecular weight is too high, the charge level distribution of the resulting toner becomes broad, and fogging tends to occur under high-temperature and high-humidity conditions. If the weight average molecular weight of the positive charge control resin is too low, the flowability of the resulting toner becomes insufficient, and the shelf stability thereof is also deteriorated. The weight average molecular weight of the positive charge control resin is a weight average molecular weight in terms of polystyrene as measured by gel permeation chromatography (GPC) using tetrahydrofuran (THF).

A proportion of the structure unit, to which the functional group bringing positively charging ability has been bonded, in the positive charge control resin is generally 0.1 to 15% by weight, preferably 0.5 to 10% by weight. In many cases, a good result can be achieved in about 1 to 6% by weight. If this structure unit is too little, there is a tendency for charging ability and charge controlling ability to lower. If this structure unit is too great on the other hand, a charge level is too high in the case of a positively charged toner to show a tendency to lower image density. In the case of a negatively charged toner, a charge level it too lower to show a tendency to cause fog and the like. Further, if this structure unit is too great, the hydrophilicity of the resulting positive charge control resin becomes too strong, and so the dispersion stability of droplets of the polymerizable monomer composition tends to be deteriorated. Proportions of the respective structure units may be substituted by a weight ratio between charged amounts of monomer components giving the respective structure units upon polymerization.

As the positive charge control resin, is preferred a copolymer having a quaternary ammonium salt group in that the charge properties of the resulting toner becomes even, with a copolymer having a vinyl aromatic hydrocarbon monomer unit, a (meth)acrylate monomer unit and a monomer unit having a quaternary ammonium salt group being more preferred. The quaternary ammonium salt group-containing polymer can be obtained by using the following monomers, polymerizing them by emulsion polymerization, dispersion polymerization, suspension polymerization, solution polymerization or the like in the presence of a polymerization initiator and then subjecting the resultant polymer to a quaternizing reaction with a proper quaternizing agent as needed.

Specific examples of the vinyl aromatic hydrocarbon monomer include styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 4-butylstyrene, 4-t-butylstyrene, 2-chlorostyrene, 3-chlorostyrene, 4-chlorostyrene, 2-methyl-α-methylstyrene, 3-methyl-α-methylstyrene and 4-methyl-α-methylstyrene. Among these, styrene and α-methylstyrene are preferred. These vinyl aromatic hydrocarbon monomers may be used either singly or in any combination thereof.

Specific examples of the acrylate monomer or methacrylate monomer include acrylates such as methyl (meth) acrylate, ethyl (meth)acrylate, propyl (meth)acrylate, isopropyl (meth)acrylate, n-butyl (meth)acrylate, isobutyl (meth)acrylate, n-amyl (meth)acrylate, isoamyl (meth) acrylate, n-hexyl (meth)acrylate, 2-ethylhexyl (meth) acrylate, hydroxypropyl (meth)acrylate and lauryl (meth) acrylate. These (meth)acrylate monomers may be used either singly or in any combination thereof.

A quaternary ammonium salt group-containing (meth) acrylate monomer unit is a structure unit represented by the formula (I):

[I]

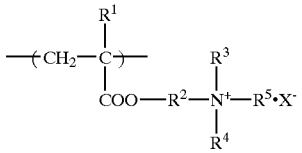

wherein $R^1$ is a hydrogen atom or a methyl group, $R^2$ is a linear or branched alkylene group which may be substituted by a halogen and has 1 to 3 carbon atoms, $R^3$ to $R^5$ are, independently of one another, a hydrogen atom or a linear, branched or cyclic alkyl group having 1 to 6 carbon atoms, and X is a halogen atom, or benzene or naphthalene which may have a linear, branched or cyclic alkyl group having 1 to 6 carbon atoms or a halogen atom and has any of $—SO_3—$, $—PO_3$ and $—BO_3^-$.

X is particularly preferably a halogen atom, or a benzenesulfonic acid anion which may have a linear, branched or cyclic alkyl group having 1 to 6 carbon atoms or a halogen atom.

As methods for introducing such a quaternary ammonium salt group-containing (meth)acrylate monomer unit into the copolymer, may be mentioned, for example, the following methods:

(i) A method in which a vinyl aromatic hydrocarbon monomer, a (meth)acrylate monomer and an N,N-disubstituted aminoalkyl (meth)acrylate monomer are copolymerized in the presence of a polymerization initiator, and the amino group in the resulting copolymer is quaternized with a quaternizing agent such as a halogenated organic compound or acid ester compound;

(ii) A method in which a monomer with an N,N-disubstituted aminoalkyl (meth)acrylate monomer converted into a quaternary ammonium salt, a vinyl aromatic hydrocarbon monomer and a (meth)acrylate monomer are copolymerized in the presence of a polymerization initiator, and the resulting copolymer is then reacted with an organic acid or a derivative thereof to form a salt;

(iii) A method in which a vinyl aromatic hydrocarbon monomer, a (meth)acrylate monomer and a quaternary ammonium salt group-containing (meth)acrylate monomer are copolymerized in the presence of a polymerization initiator; and (iv) A method in which a copolymer of a vinyl aromatic hydrocarbon monomer and a halogenated alkyl (meth) acrylate monomer is mixed with a copolymer of a vinyl aromatic hydrocarbon monomer and an amino group-containing (meth)acrylate monomer to conduct quaternization between the copolymers.

As specific examples of the an amino group-containing (meth)acrylate monomer, may be mentioned N,N-disubstituted aminoalkyl (meth)acrylates such as dimethylaminomethyl (meth)acrylate, diethylaminomethyl (meth) acrylate, dipropylaminomethyl (meth)acrylate, diisopropylaminomethyl (meth)acrylate, ethylmethylaminomethyl (meth)acrylate, methylpropylaminomethyl (meth) acrylate, dimethylamino-1-ethyl (meth)acrylate, diethylamino-1-ethyl (meth)acrylate and dipropylamino-1-ethyl (meth)acrylate. The alkyl group is preferably a alkyl group having 1 to 3 carbon atoms.

The quaternary ammonium salt group-containing (meth) acrylate is a (meth)acrylate compound having the above-described —$NR_3^+.X^-$ structure. Specific examples thereof include N,N,N-trimethyl-N-(2-methacryloxyethyl) ammonium chloride (DMC; dimethylaminoethylmethyl methacrylate chloride) and N-benzyl-N,N-dimethyl-N-(2-methacryloxyethyl)ammonium chloride (DML; dimethylaminoethylbenzyl methacrylate chloride). These monomers may also be prepared by modifying a amino group-containing (meth)acrylate monomer with a halogenated organic compound into a halogenated quaternary ammonium salt group-containing (meth)acrylate monomer.

As examples of the quaternizing agent, may be mentioned halogenated organic compounds and acid ester compounds. Examples of the halogenated organic compounds include linear, branched or cyclic alkyl halides having 1 to 6 carbon atoms, such as chloromethane, dichloromethane and trichloromethane; and aromatic halides such as chlorobenzene, 4-chlorotoluene and 1-chloronaphthalene. Examples of the acid esters include alkyl alkylsulfonates such as methyl methylsulfonate and ethyl methylsulfonate; alkyl benzenesulfonates such as methyl benzene sulfonate; alkyl p-toluenesulfonates such as methyl p-toluenesulfonate; phosphates such as trimethyl phosphate; and borates such as trimethoxyborane.

Examples of the organic acid or the derivative thereof include alkylsulfonic acids such as methylsulfonic acid; aromatic sulfonic acids such as benzenesulfonic acid and p-toluenesulfonic acid; phosphates such as trimethyl phosphate; and borates such as trimethoxyborane.

No particular limitation is imposed on the polymerization process. However, a solution polymerization process is preferred in that a copolymer having the intended weight average molecular weight is easy to obtain. Examples of a solvent include aromatic hydrocarbons such as benzene and toluene; saturated hydrocarbons such as n-hexane and cyclohexane; alcohols such as methanol, ethanol and isopropyl alcohol; nitrogen-containing organic compounds such as nitriles, amines, amides and heterocyclic compounds; oxygen-containing organic compounds such as ketones, carboxylic acid esters, ethers and carboxylic acids; chlorine-containing organic compounds such as chlorine-substituted aliphatic hydrocarbons; and sulfur-containing organic compounds. As the polymerization initiator, is used an azo compound, a peroxide or the like used in the suspension polymerization of a polymerizable monomer composition, which will be described subsequently. With respect to polymerization conditions, the polymerization temperature is generally 50 to 200° C., and the polymerization time is generally 0.5 to 20 hours.

Proportions of the respective monomers used may be optionally selected. However, the proportion of the structure unit derived from the vinyl aromatic hydrocarbon monomer in the copolymer is generally 70 to 98% by weight, preferably 75 to 95% by weight, more preferably 80 to 90% by weight, the proportion of the structure unit derived from the (meth)acrylate monomer is generally 1.9 to 29.9% by weight, preferably 4.5 to 24.5% by weight, more preferably 9 to 19% by weight, and the proportion of the structure unit derived from the quaternary ammonium salt-containing (meth)acrylate monomer is generally 0.1 to 15% by weight, preferably 0.5 to 10% by weight, more preferably 1 to 6% by weight.

(2) Negative Charge Control Resin:

The negative charge control resin (B) used in the present invention is a polymer having a weight average molecular weight of 1,000 to 100,000 and a functional group which brings negatively charging ability. This polymer may be either a homopolymer or a copolymer so far as it is a polymer having a functional group which brings negatively charging ability. The negative charge control resin is preferably a copolymer of a vinyl monomer having a functional group which brings negatively charging ability, and another vinyl monomer copolymerizable therewith. However, it may be a polymer into which the functional group has been introduced by a modification treatment after polymerization. A copolymer containing a monomer unit having a functional group which brings negatively charging ability, a vinyl aromatic hydrocarbon monomer unit and a (meth)acrylate monomer unit is particularly preferred from the viewpoint of compatibility with a binder resin. When the negative charge control resin is compatible with a binder resin in a toner, the charge properties of the toner becomes evener. The negative charge control resin is preferably soluble in a styrene monomer from the viewpoint of its dispersibility in a polymerizable monomer composition.

Examples of the functional group which brings negatively charging ability include a maleic anhydride group, a carboxyl group, a sulfuric acid residue, a sulfonic group, a phosphoric group, etc. Of these, the sulfonic group or sulfuric acid residue is preferred for the production of a toner for a non-magnetic one-component developer, with the sulfonic group being particularly preferred.

The weight average molecular weight (Mw) of the negative charge control resin is 1,000 to 100,000, preferably 2,000 to 50,000, more preferably 3,000 to 30,000. If the weight average molecular weight is too high, handling upon the production of toner particles becomes poor, and the size of droplets of the polymerizable monomer composition becomes scattered, and so it is difficult to obtain any toner particles having sharp particle diameter distribution. If the weight average molecular weight is too low on the other hand, the dispersibility of a colorant is deteriorated, the flowability of the resulting toner becomes insufficient, and the shelf stability thereof is deteriorated. The weight average molecular weight of the negative charge control resin is a weight average molecular weight in terms of polystyrene as measured by gel permeation chromatography (GPC) using THF.

A proportion of the structure unit derived from the monomer having a functional group, which brings the negatively charging ability, in the negative charge control resin is generally 0.1 to 15% by weight, preferably 0.5 to 10% by weight. In many cases, a good result can be achieved in about 1 to 6% by weight. If this structure unit is too little, there Is a tendency for charging ability and charge controlling ability to lower. If this structure unit is too great on the other hand, a charge level is too high in the case of a negatively charged toner to show a tendency to lower image density. In the case of a positively charged toner, a charge level it too lower to show a tendency to cause fog and the like.

As the negative charge control resin, is preferred a polymer having a sulfonic group from the viewpoints of dispersion stability of droplets of the polymerizable monomer composition, the charge controlling ability of the resulting toner, image quality, etc., more preferred a copolymer having a structural unit derived from a sulfonic group-containing (meth)acrylate monomer and a structural unit derived from another polymerizable monomer, and particularly preferred a copolymer having a structural unit derived from a sulfonic group-containing (meth)acrylamide monomer, a structure unit derived from a vinyl aromatic hydrocarbon monomer and a structure unit derived from a (meth)acrylate monomer. Such a copolymer can be obtained by polymerizing a sulfonic group-containing (meth) acrylamide monomer, a vinyl aromatic hydrocarbon monomer and a (meth)acrylate monomer by emulsion polymerization, dispersion polymerization, suspension polymerization, solution polymerization or the like using a polymerization initiator. Among these polymerization processes, the solution polymerization process is preferred in that a copolymer having the intended weight average molecular weight is easy to obtain. As the polymerization process, the same process as in the positive charge control resin may be adopted.

Specific examples of the vinyl aromatic hydrocarbon monomer and (meth)acrylate monomer used herein are common to the case of the positive charge control resin. Specific examples of the sulfonic group-containing (meth) acrylamide monomer include acrylamidoalkylsulfonic acids such as 2-acrylamido-1-methylpropanesulfonic acid, 2-acrylamido-2-methylpropanesulfonic acid, 2-acrylamido-n-butanesulfonic acid, 2-acrylamido-n-hexanesulfonic acid, 2-acrylamido-n-octanesulfonic acid, 2-acrylamido-n-dodecanesulfonic acid, 2-acrylamido-n-tetradecanesulfonic acid, 2-acrylamido-2-methylpropanesulfonic acid, 2-acrylamido-2-phenylpropanesulfonic acid, 2-acrylamido-2,2,4-trimethylpentane-sulfonic acid, 2-acrylamido-2-methylphenylethanesulfonic acid, 2-acrylamido-2-(4-chlorophenyl)propanesulfonic acid, 3-acrylamido-3-methylbutanesulfonic acid, 2-methacrylamido-n-decanesulfonic acid and 4-methacrylamidobenzenesulfonic acid; acrylamidocarboxyalkylsulfonic acids such as 2-acrylamido-2-carboxymethylpropanesulfonic acid; acrylamido-heterocyclic group-containing alkylsulfonic acids such as 2-acrylamido-2-(2-pyridine)propanesulfonic acid; and metal salts thereof. These sulfonic group-containing (meth)acrylamide monomers may be used either singly or in any combination thereof.

Proportions of the respective monomers used may be optionally selected. However, the proportion of the structure unit derived from the vinyl aromatic hydrocarbon monomer in the copolymer is generally 70 to 98% by weight, preferably 75 to 95% by weight, more preferably 80 to 90% by weight, the proportion of the structure unit derived from the (meth)acrylate monomer is generally 1.9 to 29.9% by weight, preferably 4.5 to 24.5% by weight, more preferably 9 to 19% by weight, and the proportion of the structure unit derived from the sulfonic group-containing (meth) acrylamide monomer is generally 0.1 to 15% by weight, preferably 0.5 to 10% by weight, more preferably 1 to 6% by weight.

(3) Amounts of Respective Charge Control Resins Used:

In the present invention, the positive charge control resin and negative charge control resin are used in combination. The proportions of the charge control resins used vary by the provision form of the resulting toner for development of electrostatic images as either a positively charged toner or a negatively charged toner. In the case where the positively charged toner is provided, the proportions of the respective charge control resins used are controlled in such a manner that the number of molar equivalents of the functional group (for example, a quaternary ammonium salt group), which brings positively charging ability, in the positive charge control resin is greater than the number of molar equivalents of the functional group (for example, a sulfonic group), which brings negatively charging ability, in the negative charge control resin. In the case where the negatively charged toner is provided, the proportions of the respective charge control resins used are controlled in such a manner that the number of molar equivalents of the functional group, which brings negatively charging ability, in the negative charge control resin is greater than the number of molar equivalents of the functional group, which brings positively charging ability, in the positive charge control resin.

In the case where a toner is produced on an industrial scale, a method of controlling a functional group ratio between the positive and negative charge control resins is simple and convenient. The functional group ratio can be calculated out as a ratio between "products of % by weight of the structure unit having the functional group in each charge control resin by the amount of the charge control resin in the toner". More specifically, a product of (% by weight of the structure unit having the functional group in the positive charge control resin)×(the amount of the positive charge control resin in the toner) is regarded as A, and a product of (% by weight of the structure unit having the functional group in the negative charge control resin)×(the amount of the negative charge control resin in the toner) is regarded as B. The functional ratio can be calculated out by A:B. The % by weight of the structure unit having the functional group in each charge control resin can be substituted by the proportion of the monomer having the functional group used upon polymerization. The amount of each charge control resin in the toner may be defined as parts by weight of the charge control resin per 100 parts by weight of the binder resin (polymerizable monomer) in the toner.

In the case where a positively charged toner is provided, proportions of both charge control resins used are determined in such a manner that the functional ratio (A:B) is generally 1:0.005 to 1:0.9, preferably 1:0.01 to 1:0.8, more preferably 1:0.05 to 1:0.7. In the case where a negatively charged toner is provided, proportions of both charge control resins used are determined in such a manner that the functional ratio (B:A) is generally 1:0.005 to 1:0.9, preferably 1:0.01 to 1:0.8, more preferably 1:0.05 to 1:0.7. If one proportion in this functional ratio is too low, the resulting toner involves such disadvantages that when continuous printing is conducted, the charge controlling ability of the charge control agent becomes insufficient, printing durability is deteriorated, and image density is lowered. On the other hand, said one proportion is too high, charge properties of the toner may become insufficient to cause problems of fogging and the like in some cases.

In the present invention, the positive charge control resin and negative charge control resin are used in combination, desirably, at the above-described functional ratio, whereby a toner for development of electrostatic images, which is sharp in particle diameter distribution and excellent in flowability and shelf stability, scarcely changed in charge properties even in both environments of low-temperature and low-humidity, and high-temperature and high-humidity, and prevented from deterioration of image quality even when conducting continuous printing can be provided.

The total proportion of the positive charge control resin and negative charge control resin used is generally 0.01 to 15 parts by weight, preferably 0.3 to 10 parts by weight per 100 parts by weight of the binder resin or the polymerizable monomer used for obtaining the binder resin. In many cases, a good result can be achieved in about 1 to 5 parts by weight.

Toner for Development of Electrostatic Image

The toner according to the present invention may be colored particles containing at least a binder resin, a colorant and a charge control agent (the above-described positive and negative charge control resins), is not particularly limited by the production process thereof and can be obtained by, for example, the grinding process or polymerization process. The toner may also be a toner (capsule toner) having a core-shell structure that a resin coating layer is formed on each surface of the colored particles. The toner according to the present invention is preferably a polymerized toner obtained by the suspension polymerization process.

The polymerized toner can be obtained by subjecting a monomer composition containing at least a polymerizable monomer, a colorant and a charge control agent to suspension polymerization in an aqueous dispersion medium containing a dispersion stabilizer. A polymer formed by polymerization of the polymerizable monomer becomes a binder resin. The polymerized toner having the core-shell structure can be obtained by using, as core particles, colored particles obtained by subjecting a monomer composition containing at least a polymerizable monomer, a colorant and a charge control agent to suspension polymerization in an aqueous dispersion medium containing a dispersion stabilizer, and subjecting a polymerizable monomer for shell to suspension polymerization in the presence of the core particles. A polymer layer formed by polymerization of the polymerizable monomer for shell becomes a resin coating layer. The monomer composition may contain various additives such as a parting agent, a crosslinkable monomer, a macromonomer, a molecular weight modifier, a lubricant and dispersion aid as needed.

(1) Polymerizable Monomer:

As the polymerizable monomers used in the present invention, may be mentioned monovinyl monomers. Specific examples thereof include styrenic monomers such as styrene, vinyltoluene and α-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used either singly or in any combination thereof. Among these monovinyl monomers, the styrenic monomers and the derivatives of (meth)acrylic acid are preferably used in combination.

(2) Crosslinkable Monomer:

When a crosslinkable monomer is used in addition to the polymerizable monomer, the hot offset resistance of the resulting toner can be effectively improved. The crosslinkable monomer is a monomer having two or more polymerizable carbon-carbon unsaturated double bonds. Specific examples thereof include aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups. These crosslinkable monomers may be used either singly or in any combination thereof. The crosslinkable monomers are used in a proportion of generally 0.01 to 5 parts by weight, preferably 0.1 to 1 part by weight per 100 parts by weight of the polymerizable monomer (3) Macromonomer:

When a macromonomer is used together with the polymerizable monomer, a balance between the shelf stability and offset resistance, and the low-temperature fixing ability of the resulting polymerized toner can be improved. The macromonomer is a relatively long-chain linear molecule having a polymerizable functional group (for example, a unsaturated group such as a carbon-carbon double bond) at its molecular chain terminal. The macromonomer is preferably an oligomer or polymer having a number average molecular weight of generally 1,000 to 30,000. Among the macromonomers, polymers having a higher glass transition temperature than that of the binder resin, particularly, copolymers of styrene and methacrylic esters and/or an acrylic ester are preferred. When the macromonomer is used, it is used in a proportion of generally 0.01 to 10 parts by weight, preferably 0.03 to 5 parts by weight per 100 parts by weight.of the polymerizable monomer.

(4) Colorant:

As the colorant, may be used any of various kinds of pigments and dyes used in the field of toners. As examples of black colorants, may be mentioned dyes and pigments such as carbon black and Nigrosine Base; and magnetic powders such as cobalt, nickel, triiron tetroxide, manganese iron oxide, zinc iron oxide and nickel iron oxide. When carbon black is used, that having a primary particle diameter of 20 to 40 nm is preferably used in that the resulting toner can provide images good in image quality, and the safety of the toner in environment is enhanced. As colorants for color toners, may be used yellow colorants, magenta colorants, cyan colorants, etc. Specific examples thereof include Naphthol Yellow S, Hansa Yellow G, C.I. Pigment Yellow, C.I. Vat Yellow, eosine lake, C.I. Pigment Red, C.I. Pigment Violet, C.I. Vat Red, Phthalocyanine Blue, C.I. Pigment Blue, C.I. Vat Blue and C.I. Acid Blue. The colorants are used in a proportion of generally 0.1 to 50 parts by weight, preferably 1 to 20 parts by weight per 100 parts by weight of the polymerizable monomer.

(5) Molecular Weight Modifier:

As examples of the molecular weight modifier, may be mentioned mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the polymerizable monomer.

(6) Lubricant and Dispersion Aid:

A lubricant, such as a fatty acid such as oleic acid or stearic acid, or a fatty acid metal salt composed of a fatty acid and a metal such as Na, K, Ca, Mg or Zn; a dispersion aid such as a silane or titanium coupling agent; and/or the like may also be used with a view toward uniformly dispersing the colorant in the resulting toner particles. Such a lubricant or dispersion aid is generally used in a proportion of about 1/1,000 to 1/1 based on the weight of the colorant.

(7) Charge Control Agent:

In the present invention, the above-described positive control change resin and negative charge control resin are used in combination as the charge control agent. Other charge control agents or charge control resins than these charge control resins may be suitably contained within limits not impeding the objects of the present invention.

(8) Parting Agent:

The parting agent is preferably added for the purpose of preventing offset. As specific examples thereof, may be mentioned low molecular weight polyolefins such as low molecular weight polyethylene, low molecular weight polypropylene and low molecular weight polybutylene; molecular terminal-modified polyolefin waxes such as molecule terminal-oxidized low molecular weight polypropylene, molecular terminal-modified low molecular weight polypropylene substituted by an epoxy group at its molecular terminal and block polymers of these compounds with low molecular weight polyethylene, and molecule terminal-oxidized low molecular weight polyethylene, molecular terminal-modified low molecular weight polyethylene substituted by an epoxy group at its molecular terminal and block polymers of these compounds with low molecular weight polypropylene; vegetable natural waxes such as candelilla wax, carnauba wax, rice wax, Japan wax and jojoba wax; petroleum waxes such as paraffin wax, microcrystalline wax and petrolatum, and modified waxes thereof; mineral waxes such as montan, ceresin and ozokerite; synthetic waxes such as Fischer-Tropsch wax; and mixtures thereof. The parting agent is used in a proportion of generally 0.1 to 40 parts by weight, preferably 0.5 to 20 parts by weight per 100 parts by weight of the polymerizable monomer.

(9) Polymerization Initiator:

As the polymerization initiator, is used a radical polymerization initiator. As specific examples thereof, may be mentioned persulfates such as potassium persulfate and ammonium persulfate; azo compounds such as 4,4'-azobis(4-cyanovaleric acid), 2,2'-azobis(2-amidino-propane) dihydrochloride, 2,2'-azobis(2-methyl-N(1,1-bis (hydroxymethyl)-2-hydroxyethyl)propionamide), 2,2'-azobis(2,4-dimethylvaleronitrile), 2,2'-azobis-isobutyronitrile and 1,1'-azobis(cyclohexane-1'-carbonitrile); diacyl peroxides such as isobutyryl peroxide, 2,4-di-chlorobenzoyl peroxide and 3,5,5-trimethylhexanoyl peroxide; peroxy dicarbonates such as bis(4-t-butylcyclohexyl)peroxy dicarbonate, di-n-propylperoxy dicarbonate, diisopropylperoxy dicarbonate, di-2-ethoxyethylperoxy dicarbonate, di(2-ethylhexylperoxy) dicarbonate, dimethoxybutylperoxy dicarbonate and di(3-methyl-3-methoxybutylperoxy) dicarbonate; and other peroxides such as ($\alpha$,$\alpha$-bis-neodecanoylperoxy)-diisopropylbenzene, cumylperoxy neodecanoate, 1,1,3,3-tetramethylbutylperoxy neodecanoate, 1-cyclohexyl-1-methylethylperoxy neodecanoate, t-hexylperoxy neodecanoate, t-butylperoxy neodecanoate, t-hexylperoxy pivalate, t-butylperoxy pivalate, methyl ethyl peroxide, di-t-butyl peroxide, acetyl peroxide, dicumyl peroxide, lauroyl peroxide, benzoyl peroxide, t-butylperoxy-2-ethyl hexanoate, di-isopropylperoxy dicarbonate and di-t-butylperoxy isophthalate. Redox initiators composed of combinations of these polymerization initiators with a reducing agent may also be mentioned.

Of these, oil-soluble radical polymerization initiators are preferred, with oil-soluble radical initiators selected from among organic peroxides whose decomposition temperature giving a half-life period of 10 hours are 40 to 80° C., preferably 45 to 80° C. and whose molecular weights are 300 or lower being particularly preferred because odor upon printing can be improved. The proportion of the polymerization initiator used is generally 0.1 to 10 parts by weight per 100 parts by weight of the polymerizable monomer. If this proportion is too low, the rate of polymerization becomes slow. If the proportion is too high, the molecular weight of the resulting polymer becomes low. It is hence not preferred to use the polymerization initiator in such a too low or high proportion.

(10) Dispersion Stabilizer:

The dispersion stabilizer used in the present invention is preferably that containing colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, the dispersing agents containing the colloid of a hardly water-soluble metal hydroxide are preferred because the particle diameter distribution of the resulting polymer particles can be narrowed, and the brightness or sharpness of an image formed from such a polymerized toner is enhanced.

The dispersing agent containing the colloid of the hardly water-soluble metal hydroxide is not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase. The colloid of the hardly water-soluble metal hydroxide used in the present invention preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m.

The dispersing agent is generally used in a proportion of 0.1 to 20 parts by weight per 100 parts by weight of the polymerizable monomer. If this proportion is too low, it is difficult to achieve sufficient dispersion stability, so that the resulting polymer tends to aggregate. If this proportion is too high on the other hand, the viscosity of the resulting dispersion becomes too high, and polymerization stability is lowered.

In the present invention, a dispersing agent containing a water-soluble polymer may be used as needed. As examples of the water-soluble polymer, may be mentioned polyvinyl alcohol, methyl cellulose and gelatin. In the present invention, there is no need to use any surfactant. However, a surfactant may be used for the purpose of stably conducting the suspension polymerization so far as the dependence of the charge properties of the resulting polymerized toner on environment does not become high.

(11) Production Process of Polymerized Toner:

1. Suspension Polymerization Process:

The polymerized toner is composed of polymer particles containing a binder resin formed by polymerization of a polymerizable monomer, a colorant, a charge control agent and the like. This polymerized toner can be obtained by, for example, the following procedure. A polymerizable monomer, a colorant, a charge control agent (positive and negative charge control resins) and other additives are mixed by means of a mixer such as a bead mill, and the mixture is ground by means of a media type wet grinding machine or the like, as needed, to prepare a monomer composition. The monomer composition is dispersed in an aqueous dispersion medium containing a dispersion stabilizer, and the resultant suspension is stirred to form uniform droplets (primary droplets having a volume average particle diameter of about 50 to 1,000 μm) of the monomer composition. In order to avoid premature polymerization, the time when a polymerization initiator is added may be the time the size of the droplets in the aqueous dispersion medium has become uniform.

A polymerization initiator is added to the suspension in which the droplets of the monomer composition are dispersed, to mix them. The resultant mixture is further formed into droplets by means of a high-speed shearing stirrer in such a manner that the droplet diameter thereof becomes a small diameter close to that of the intended toner particles. The suspension containing the droplets (secondary droplets having a volume average particle diameter of about 1 to 12 μm) thus formed is charged into a polymerization reactor to conduct suspension polymerization at a temperature of generally 5 to 120° C., preferably 35 to 95° C. If the polymerization temperature is too lower, it is necessary to use a polymerization initiator high in catalytic activity, and so it is difficult to control the polymerization reaction. If the polymerization temperature is too high on the other hand, additives melted at a low temperature may tend to bleed into the surface of the resulting toner if contained, and the shelf stability of the toner may be deteriorated in some cases.

The volume average droplet diameter and droplet diameter distribution of the droplets (secondary droplets) of the monomer composition affect the volume average particle diameter and particle diameter distribution of the resulting toner. If the droplet diameter of the droplets is too great, toner particles formed become too great, so that the resolution of an image formed with such a toner is deteriorated. If the droplet diameter distribution of the droplets is too broad, the fixing temperature of the resulting toner varies, so that inconveniences such as fogging and toner filming tend to occur. It is therefore desirable to form droplets so as to become small up to the size of the intended toner particles.

The volume average droplet diameter of the droplets of the monomer composition is generally 1 to 12 μm, preferably 2 to 11 μm, more preferably 3 to 10 μm. When a particularly fine toner is provided for the purpose of obtaining images of high definition, it is desirable that the volume average droplet diameter of the droplets be controlled to preferably 2 to 9 μm, more preferably 3 to 8 μm, still more preferably about 7 μm. The droplet diameter distribution (the volume average droplet diameter/the number average droplet diameter) of the droplets of the monomer composition is generally 1 to 3, preferably 1 to 2.5, more preferably 1 to 2. When particularly fine droplets are formed, a method in which the aqueous dispersion medium containing the monomer composition is passed through between a rotor which rotates on its axis at high speed, and a stator surrounding it and having small openings or comb-like teeth is preferably adopted.

As the polymerizable monomer, at least one of the above-described monovinyl monomers is selected. In order to lower a fixing temperature, however, a monomer or a combination of monomers that can form a polymer having a glass transition temperature (Tg) of generally at most 80° C., preferably 50 to 80° C., more preferably 55 to 70° C. is preferably chosen. In the present invention, Tg of a copolymer constituting the binder resin is a calculated value (referred to as calculated Tg) calculated out according to the kinds and proportions of monomers used in accordance with the following equation:

$$100/Tg=W_1/T_1+W_2/T_2+W_3/T_3+\ldots W_n/T_n$$

wherein

Tg: the glass transition temperature of the copolymer (absolute temperature), $W_1$, $W_2$, $W_3$ . . . $W_n$: % by weight of the monomers forming the copolymer composition, $T_1$, $T_2$, $T_3$ . . . $T_n$: glass transition temperature (absolute temperature) of a homopolymer formed from each of the monomers.

n: the number of the monomers.

The numbers attached to W and T indicate that such numerical values are those as to the same monomer.

By the suspension polymerization, polymer particles (colored particles) comprising the binder resin formed by the polymerization of the polymerizable monomer, the colorant, the charge control agent, etc. are formed. In the present invention, these colored particles may be used as a toner. In order to improve the shelf stability (blocking resistance), low-temperature fixing ability and melt property upon fixing, etc. of the toner, a resin coating layer may be further formed on each surface of the colored particles obtained by the suspension polymerization to provide a toner having a core-shell structure.

2. Production Process of Toner Having Core-shell Structure:

No particular limitation is imposed on the process for forming a core-shell structure. In the case of a polymerized toner, however, is preferably used a process in which the above-described colored particles are used as core particles, and a polymerizable monomer for shell is polymerized in the presence of the core particles to form a polymer layer (shell) on each surface of the core particles. When a monomer capable of forming a polymer having a glass transition temperature higher than Tg of the polymer component forming the core particles is used as the monomer for shell, the shelf stability of the resulting toner can be improved. When Tg of the polymer component forming the core particles is preset low, the fixing temperature of the resulting toner can be lowered, and evenly melting ability thereof can be improved, whereby the toner can suitably meet the requirements of the speeding-up of printing (copying, printing, etc.), formation of full-color images, permeability through OHP (overhead projector).

As polymerizable monomers for forming the core and shell, preferable monomers may be suitably selected from among the above-described monovinyl monomers. A weight ratio of the polymerizable monomer for core to the polymerizable monomer for shell is generally 40/60 to 99.9/0.1, preferably 60/40 to 99.5/0.5, more preferably 80/20 to 99/1. If the proportion of the polymerizable monomer for shell is too low, the effect of improving the shelf stability becomes little. If the proportion is too high on the other hand, the low-temperature fixing ability of the resulting polymerized toner is deteriorated.

Tg of the polymer formed from the polymerizable monomer for shell is generally higher than 50° C., but not higher than 120° C., preferably higher than 60° C., but not higher than 110° C., more preferably higher than 80° C., but not higher than 105° C. A difference in Tg between the polymer formed from the polymerizable monomer for core and the polymer formed from the polymerizable monomer for shell is preferably at least 10° C., more preferably at least 20° C., particularly preferably at least 30° C. In many cases, a monomer capable of forming a polymer having a Tg of generally at most 60° C., preferably 40 to 60° C. is preferably selected as the polymerizable monomer for core from the viewpoint of a balance between fixing temperature and shelf stability. On the other hand, as the polymerizable monomer for shell, there may be preferably used monomers capable of forming a polymer having a glass transition temperature higher than 80° C., such as styrene and methyl ethacrylate, either singly or in combination of two or more monomers thereof.

The polymerizable monomer for shell is preferably added to the polymerization reaction system as droplets smaller than the average particle diameter of the core particles. If the droplet diameter of the droplets of the polymerizable monomer for shell is too great, it is difficult to uniformly form the polymer layer about the core particles. In order to form the monomer for shell into fine droplets, it is only necessary to subject a mixture of the monomer for shell and an aqueous dispersion medium to a finely dispersing treatment by means of, for example, an ultrasonic emulsifier and add the resultant dispersion to the reaction system. When the polymerizable monomer for shell is a relatively water-soluble monomer (for example, methyl methacrylate) having a solubility of at least 0.1% by weight in water at 20° C., the monomer tends to relatively quickly migrate into the surfaces of the core particles, so that there is no need to conduct the finely dispersing treatment. However, it is preferable to conduct the finely dispersing treatment from the viewpoint of forming a uniform shell. On the other hand, when the polymerizable monomer for shell is a monomer having a solubility lower than 0.1% by weight in water at 20° C., it is preferable that the monomer be made liable to migrate into the surfaces of the core particles by conducting the finely dispersing treatment or adding an organic solvent (for example, alcohol) having a solubility of at least 5% by weight in water at 20° C. to the reaction system.

A charge control agent may be added to the polymerizable monomer for shell. As the charge control agent, may be used the same charge control agent as that used in the production of the core particles. When the charge control agent is used, it is used in a proportion of generally 0.01 to 10 parts by weight, preferably 0.1 to 5 parts by weight per 100 parts by weight of the polymerizable monomer for shell.

In order to produce the polymerized toner of the core-shell structure, the polymerizable monomer for shell (including an aqueous dispersion thereof) is added to the suspension containing the core particles (colored particles) in one lot, or continuously or intermittently. It is preferable from the viewpoint of formation of the shell to add a water-soluble radical initiator at the time the polymerizable monomer for shell is added. As examples of the water-soluble radical initiator, may be mentioned persulfates such as potassium persulfate and ammonium persulfate; azo initiators such as 4,4'-azobis(4-cyanovaleric acid), 2,2'-azobis(2-amidinopropane) bihydrochloride and 2,2'-azobis-2-methyl-N-1,1-bis-(hydroxymethyl)-2-hydroxyethylpropionamide; and combinations of an oil-soluble initiator such as cumene peroxide with a redox catalyst. The amount of the water-soluble radical initiator used is generally 0.01 to 50 parts by weight, preferably 0.1 to 20 parts by weight per 100 parts by weight of the polymerizable monomer for shell.

The average thickness of the shell is generally 0.001 to 1.0 μm, preferably 0.003 to 0.5 μm, more preferably 0.005 to 0.2 μm. If the thickness of the shell is too great, the fixing ability of the toner is deteriorated. If the thickness is too small on the other hand, the shelf stability of the toner is deteriorated. The particle diameters of the core particles and the thickness of the shell in the polymerized toner can be determined by directly measuring the size and shell thickness of each of particles selected at random from electron photomicrographs thereof when they can be observed through an electron microscope. If the core and the shell are difficult to observe through the electron microscope, the thickness of the shell can be calculated out from the particle diameter of the core particles and the amount of the polymerizable monomer forming the shell.

(12) Toner:

The volume average particle diameter of the toner for development of electrostatic images (including that of the core-shell structure) according to the present invention is generally 1 to 12 μm, preferably 2 to 11 μm, more preferably 3 to 10 μm. In order to enhance resolution to obtain images of extremely high definition, it is particularly desirable that the volume average particle diameter of the toner be controlled to preferably 2 to 9 μm, more preferably 3 to 8 μm, particularly preferably 3 to 7 μm. The particle diameter distribution represented by a ratio of the volume average particle diameter (dv) to the number average particle diameter (dp) of the toner according to the present invention is generally at most 1.7, preferably at most 1.5, more preferably at most 1.4. If the volume average particle diameter of the toner is too great, resolution is liable to lower. If the particle diameter distribution of the toner is too broad, a proportion of toner particles having a great particle diameter becomes high, and so resolution is liable to lower.

The polymerized toner according to the present invention is preferably substantially spherical as demonstrated by a spheroidicity represented by a ratio (dl/ds) of the length (dl) to the breadth (ds) of preferably 1 to 1.3, more preferably 1 to 1.2. When a substantially spherical toner is used as a non-magnetic one-component developer, the transfer efficiency of a toner image on a photosensitive member to a transfer medium is enhanced. Such a spherical toner can be obtained by the suspension polymerization process.

The standard deviation of the number particle diameter distribution of the toner according to the present invention is generally at most 1.8, preferably 1.3 to 1.8, more preferably 1.4 to 1.7. If the standard deviation is too great, the flowability of the toner is lowered as the number of sheets printed increases, and fog on the resulting image increases, and blur is liable to occur. The % by number, % by volume and standard deviation are values measured by means of a Multisizer (manufactured by Coulter Co.). Such a toner is obtained as a polymerized toner narrow in particle diameter distribution by the suspension polymerization. However, a classification treatment may be conducted after the suspension polymerization to remove particles of too great and small particle diameters.

In order to enhance a balance between shelf stability and low-temperature fixing ability and provide an image of extremely high definition, the toner is particularly preferably a polymerized toner having the following features:

(a) the volume average particle diameter is 2 to 9 μm, preferably 3 to 8 μm, more preferably 3 to 7 μm;

(b) the standard deviation of the number particle diameter distribution is at most 1.8, preferably at most 1.7;

(c) the spheroidicity represented by a ratio (dl/ds) of the length (dl) to the breadth (ds) of each particle is 1 to 1.3, preferably 1 to 1.2; and (d) the particle diameter distribution represented by a ratio (dv/dp) of the volume average particle diameter (dv) to the number average particle diameter (dp) of the toner is at most 1.7, preferably at most 1.5, more preferably at most 1.4.

(13) Non-magnetic One-component Developer:

When the toner according to the present invention is used as a non-magnetic one-component developer, external additives may be mixed as needed. As the external additives, may be mentioned inorganic particles and organic resin particles which act as a flowability-imparting agent and an abrasive.

Examples of the inorganic particles include particles of silica, alumina, titanium oxide, zinc oxide, tin oxide, barium titanate, strontium titanate, etc. Examples of the organic resin particles include particles of methacrylic ester polymers, acrylic ester polymers, styrene-methacrylic ester copolymers and styrene-acrylic ester copolymers, and core-shell type particles in which the core is composed of a methacrylic ester polymer, and the shell is composed of a styrene polymer.

Of these, titanium oxide, particularly conductive titanium oxide having an electric resistance of 100 Ω·cm or lower is particularly preferred from the viewpoint of charge stability upon duration. From the viewpoints of flowability and abrasion property, the particles of the inorganic oxides, particularly, the silicon dioxide particles are preferred. Two or more of the external additives may be used in combination. When the external additives are used in combination, it is preferable to use two kinds of inorganic oxide particles different in average particle diameter from each other and a metal oxide in combination. For example, when two kinds of silica having a great particle diameter and a small particle diameter, and conductive titanium oxide are used in combination, a filming preventing effect can be achieved. As examples of a combination of inorganic oxide particles different in average particle diameter, may be mentioned a combination of particles having an average particle diameter of 5 to 20 nm, preferably 7 to 18 nm and particles having an average particle diameter of greater than 20 nm, preferably 30 nm to 1 μm. The inorganic oxide particles different in average particle diameter are used at a weight ration of generally 1:5 to 5:1, preferably 3:10 to 10:3.

The surfaces of the inorganic fine particles may be subjected to a hydrophobicity-imparting treatment. Silicon dioxide particles subjected to the hydrophobicity-imparting treatment are particularly preferred. No particular limitation is imposed on the amount of the external additives added. However, it is generally 0.1 to 6 parts by weight in total per 100 parts by weight of the toner particles. The adhesion of the external additives to the toner particles is generally conducted by charging them into a mixer such as a Henschel mixer to mix them under stirring.

EXAMPLES

The present invention will hereinafter be described more specifically by the following Examples and Comparative Examples. All designations of "part" or "parts" and "%" as will be used in the following examples mean part or parts by weight and % be weight unless expressly noted.

Various physical properties and properties in the following Examples and Comparative Examples were evaluated in accordance with the following respective methods.

(1) Weight Average Molecular Weight (Mw)

The weight average molecular weight (Mw) of each of the quaternary ammonium salt group-containing polymers and sulfonic group-containing polymers was determined in terms of polystyrene by gel permeation chromatography (GPC).

Measuring conditions by the GPC are as follows:

① Preparation of Sample:

A polymer (about 10 mg) to be measured was dissolved in 5 ml of tetrahydrofuran (THF), and the solution was left to stand for 16 hours at 25° C. and then filtered through a membrane filter having a pore size of 0.45 μm to prepare a sample.

② Measuring Conditions:

Temperature: 35° C., solvent: THF, flow rate: 1.0 ml/min, concentration: 0.2% by weight, amount poured: 100 μl.

③ Column:

Shodex GPC KF806M (30 cm×2 columns) manufactured by Showa Denko K.K. was used.

(2) Particle Diameter

The volume average droplet diameter (dv), and particle diameter distribution represented by a ratio (dv/dp) of the volume average droplet diameter (dv) to the number average droplet diameter (dp) of droplets were measured by means of an SALD particle diameter distribution meter (2000A type, manufactured by Shimadzu Corporation). The volume average particle diameter (dv) of polymer particles and particle diameter distribution represented by a ratio (dv/dp) of the volume average particle diameter (dv) to the number average particle diameter (dp) of polymer particles, % by number of particles having a particle diameter of 5 μm or smaller, % by volume of particles having a particle diameter of 12 μm or greater and the standard deviation of the number particle diameter distribution were measured by means of a Multisizer (manufactured by Coulter Co.). The measurement by the Multisizer was conducted under the following conditions:

aperture diameter: 100 μm;

medium: Isothone II, concentration: 10%; and number of particles measured: 50,000 particles.

(3) Spheroidicity

An electron microphotograph of a.toner sample was taken, and read by a Nexas 9000 type image processing apparatus to determine a ratio (rl/rs) of a length rl to a breadth rs thereof. The value was regarded as the spheroidicity. The number of particles measured was 100 articles.

(4) Thickness of Shell

In the examples of the present invention, the thickness of shell in each toner sample was calculated out in the following equation, since the thickness of the shell was thin though it can be measured by the Multisizer or through an electron microscope where the thickness of the shell is great.

$$x=r(1+s/100\rho)^{1/3}-r$$

wherein r: the radius of core particles before addition of a monomer for shell (a half of the volume average particle diameter of the core particles found from measurement by the Multisizer; μm);

x: the thickness (μm) of shell:

s: the number of parts of the monomer for shell added per 100 parts by weight of a monomer for core ρ: the density of a polymer forming the shell.

In this measurement, ρ is regarded as 1.0 (g/cm$^3$) to calculate out the value of x.

(5) Flowability

Three kinds of sieves having sieve openings of 150 μm, 75 μm and 45 μm, respectively, are laid on top of another in that order from above, and a toner sample (4 g) to be measured was precisely weighed and put on the uppermost sieve. The three kinds of sieves are then vibrated for 15 seconds by means of a powder measuring device ("REOSTAT", trade name; manufactured by Hosokawa Micron Corporation) under conditions of vibration intensity of 4. Thereafter, the weight of the toner captured on each sieve was measured and substituted into its corresponding equation ①, ② or ③ shown below, thereby finding the value of a, b and c. These values were substituted into the equation ④ to calculate out the value of flowability. The measurement was conducted 3 times on one sample to find an average value thereof.

a=[(weight (g) of the toner remaining on the sieve of 150 μm)/4 g]×100 ① b=[(weight (g) of the toner remaining on the sieve of 75 μm/)4 g]×100×0.6 ② c=[(weight (g) of the toner remaining on the sieve of 45 μm)/4 g]×100×0.2 ③

Flowability (%)=100−(a+b+c). ④

(6) Shelf Stability

Each toner sample was placed in a closed container to seal it, and the container was sunk into a constant-temperature water bath controlled to 55° C. The container was taken out of the constant-temperature water bath after a certain period of time had elapsed, and the toner contained in the container was transferred to a 42-mesh sieve. At this time, the toner was quietly taken out of the container so as not to destroy the aggregate structure of the toner in the container, and carefully transferred to the sieve. The sieve was vibrated for 30 seconds by means of the above powder measuring device under conditions of vibration intensity of 4.5. The weight of the toner remaining on the sieve was then measured to regard it as the weight of the toner aggregated. A proportion (wt.%) by weight of the aggregated toner to the weight of the toner first put into the container was calculated out. The measurement was conducted 3 times on one sample to use the average value thereof as an index to the shelf stability.

(7) Charge Level

A toner sample was charged into a printer (20 papers per minute printer) of the non-magnetic one-component development system under respective environments of low-temperature/low-humidity (L/L; 10° C. in temperature and 20% in relative humidity), normal-temperature/normal-humidity (N/N; 23° C. in temperature and 50% in relative humidity) and high-temperature/high-humidity (H/H; 35° C. in temperature and 80% in relative humidity) and left to stand for 24 hours. Thereafter, a print pattern of half tone was printed 5 times, and the toner on a developing roll was then sucked in a suction type charge level meter to measure a charge level per unit weight from the charge level and weight of the toner sucked at this time. The dependence of charge properties of the toner on environment can be evaluated from changes in charge level with changes in environmental conditions.

(8) Fixing Temperature

A commercially available printer (12 papers per minute printer) of the non-magnetic one-component development system was modified in such a manner that the temperature of a fixing roll can be varied. This modified printer was used to conduct a fixing test. The fixing test was carried out by varying the temperature of the fixing roll in the modified printer to determine the fixing rate at each temperature, thereby finding a relationship between the temperature and the fixing rate. The fixing rate was calculated from the ratio of image densities before and after a peeling operation using an pressure-sensitive adhesive tape, which was conducted against a black solid-printed area of a test paper sheet, on which printing had been made by the modified printer. More specifically, assuming that the image density before the peeling of the adhesive tape is IDbefore, and the image density after the peeling of the adhesive tape is $ID_{after}$, the fixing rate can be calculated out from the following equation:

$$\text{Fixing rate}=(ID_{after}/ID_{before})\times 100$$

The peeling operation of the adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co. In this fixing test, a temperature of the fixing roll at which a fixing rate of the toner amounted to 80% was defined as a fixing temperature of the toner.

(9) Offset Temperature

Black solid printing was conducted by varying a fixing temperature like the fixing temperature test to define a temperature of the fixing roll at which offset occurred as an offset temperature.

(10) Dependence of Image Quality on Environment

The dependence of image quality of an image formed from each toner sample on environment was evaluated by the following 2 methods.

① The Number of Sheets Continuously Printed:

The above-described modified printer was used to continuously conduct printing from the beginning under respective environments of high-temperature/high-humidity (H/H; 35° C. in temperature and 80% in relative humidity) and low-temperature/low-humidity (L/L; 10° C. in temperature and 20% in relative humidity), thereby counting the number of printed sheets that continuously retained an image density of 1.3 or higher as measured by a reflection densitometer (manufactured by McBeth Co.) and at an unprinted area, fog of 15% or lower as determined by a whiteness meter (manufactured by Nippon Denshoku K.K.). Assuming that the whiteness degree after the printing is B, and the whiteness degree before the printing is A, the fog can be calculated out from the following equation:

$$\text{Fog}=[(B-A)/A]\times 100$$

② Image Density (ID) and Fog:

The above-described modified printer was used to continuously conduct printing from the beginning under respective environments of high-temperature/high-humidity (H/H; 35° C. in temperature and 80% in relative humidity) and low-temperature/low-humidity (L/L; 10° C. in temperature and 20% in relative humidity). After continuous printing on 1,000 sheets, an image density (ID) was measured by a reflection densitometer (manufactured by McBeth Co.), and fog at an unprinted area was determined by a whiteness meter (manufactured by Nippon Denshoku K.K.).

(11) Durability

Printing was continuously conducted from the beginning by means of the above-described modified printer under an environment of normal-temperature/normal-humidity (N/N; 23° C. in temperature and 50% in relative humidity) to count the number of printed sheets that continuously retained an image density of 1.3 or higher as measured by a reflection densitometer (manufactured by McBeth Co.) and at an unprinted area, fog of 15% or lower as determined by a whiteness meter (manufactured by Nippon Denshoku K.K.).

(12) Resolution

A commercially available printer of 600 dpi was used to print one-dot line and one-dot white line, and two-dot line and two-dot white line, thereby observing the printed images through a light microscope. The resolution was evaluated in accordance with the following standard:

○: the one-dot line and one-dot white line were reproduced;

Δ: the one-dot line and one-dot white line were not reproduced, but the two-dot line and two-dot white line were reproduced; and X: even the two-dot line and two-dot white line were not reproduced.

Example 1

1. Synthesis of Quaternary Ammonium Salt Group-containing Copolymer ($A_1$) (Positive Charge Control Resin)

Into 900 parts of toluene, were poured 100 parts of a polymerizable monomer mixture composed of 89% of styrene, 9% of n-butyl acrylate and 2% of N-benzyl-N,N-dimethyl-N-(2-methacryloxyethyl)ammonium chloride, and the monomer was caused to react at 80° C. for 8 hours in the presence of 4 parts of azobisdimethylvaleronitrile. After completion of the reaction, toluene was distilled off under reduced pressure to obtain a quaternary ammonium salt group-containing copolymer ($A_1$) (Mw=25,000).

2. Synthesis of Sulfonic Group-containing Copolymer ($B_1$) (Negative Charge Control Resin)

Into 900 parts of toluene, were poured 100 parts of a polymerizable monomer mixture composed of 90.5% of styrene, 9% of n-butyl acrylate and 0.5% of 2-acrylamido-2-methylpropanesulfonic acid, and the monomer was caused to react at 80° C. for 8 hours in the presence of 4 parts of azobisdimethylvaleronitrile. After completion of the reaction, toluene was distilled off under reduced pressure to obtain a sulfonic group-containing copolymer ($B_1$) (Mw=16,000).

3. Preparation of Dispersion of Styrene/parting Agent

Ninety parts of styrene and 10 parts of a parting agent ("Paraflint Spray 30", trade name; Fischer-Tropsch wax produced by Schumann Sutherl Co.) were wet-ground by means of a media type wet grinding machine to prepare a styrene/parting agent dispersion having a solids content of 10.0%, in which the parting agent had been uniformly dispersed in styrene. The particle diameter of the parting agent in this dispersion was measured by means of SALD 2000J (manufactured by Shimadzu Corporation) and found to be 3.2 $\mu$m in terms of $D_{50}$.

4. Preparation of Monomer Composition

Twenty parts (composition: parting agent 2 parts, and styrene 18 parts) of the styrene/parting agent dispersion obtained above, 65 parts of styrene and 17 parts of n-butyl acrylate were mixed, to which 7 parts of carbon black ("#25B", trade name; product of Mitsubishi Kagaku Co., Lt.), 2 parts of the quaternary ammonium salt group-containing copolymer ($A_1$), 1 part of the sulfonic group-containing copolymer ($B_1$), 1.5 parts of t-dodecylmercaptan and 0.6 parts of divinylbenzene were added. After the resultant mixture was stirred and mixed, the mixture was uniformly dispersed by a media type dispersing machine. In the dispersion, were dissolved 5 parts of t-butyl peroxy-2-ethylhexanoate (product of Nippon Oil & Fats Co., Ltd.) as a polymerization initiator, thereby obtaining a monomer composition.

5. Preparation of Aqueous Dispersion Medium Containing Dispersion Stabilizer

An aqueous solution with 4.8 parts of sodium hydroxide dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide).

6. Suspension Polymerization

The monomer composition prepared above was poured into the colloidal dispersion of magnesium hydroxide obtained above, the mixture was stirred at 12,000 rpm under high shearing force by means of a TK type homomixer to form droplets. The thus-prepared aqueous dispersion containing droplets of the polymerizable monomer composition was charged into a reactor equipped with an agitating blade to initiate a polymerization reaction at 90° C. After the reaction was continuously conducted for 8 hours, the reaction was stopped to obtain an aqueous dispersion (pH: 11) containing particles of a polymer formed.

While stirring the aqueous dispersion, it was washed (25° C., 10 minutes) with sulfuric acid to adjust the pH of the system to about 5.5. The thus-treated dispersion was then filtered and dehydrated. After the dehydration, washing water was sprayed on the residue to conduct water washing. Thereafter, the thus-treated residue was dried for 2 days by a dryer (at 45° C.) to recover polymer particles.

7. Preparation of Non-magnetic One-component Developer

To 100 parts of the polymer particles obtained above, were added 0.3 parts of a mixture ("EC300", trade name; product of Titan Kogyo K.K.) of tin oxide/titanium oxide/antimony oxide, 0.6 parts of colloidal silica ("HVK2150", trade name; product of Clariant Co.) and 1 part of colloidal silica ("NEA50", trade name; product of Nippon Aerosil Co., Ltd.), and they were mixed by means of a Henschel mixer to prepare a non-magnetic one-component developer (toner) having a volume average particle diameter (dv) of 9.6 $\mu$m. This toner was used to conduct evaluation as to image quality. As a result, the image density and fog values were lower than the respective prescribed values in respective continuous printing up to 13,000 sheets under high-temperature and high-humidity (H/H), 9,000 sheets under low-temperature and low-humidity (L/L) and 19,000 sheets in the durability test. The results are shown in Table 1.

Example 2

A toner was obtained in the same manner as in Example 1 except that in the step of "4. Preparation of monomer composition" in Example 1, the amount of the sulfonic group-containing copolymer ($B_1$) added was changed from 1 part to 3 parts. This toner was used to conduct evaluation as to image quality. As a result, the image density and fog values were lower than the respective prescribed values in respective continuous printing up to 11,000 sheets under high-temperature and high-humidity (H/H), 11,000 sheets under low-temperature and low-humidity (L/L) and 23,000 sheets in the durability test. The results are shown in Table 1.

Comparative Example 1

A toner was obtained in the same manner as in Example 1 except that in the step of "4. Preparation of monomer composition" in Example 1, no sulfonic group-containing copolymer ($B_1$) was used. This toner was used to conduct evaluation as to image quality. As a result, the image density and fog values were lower than the respective prescribed values in respective continuous printing up to 5,000 sheets under high-temperature and high-humidity (H/H), 2,000 sheets under low-temperature and low-humidity (L/L) and 8,000 sheets in the durability test. However, thereafter, both values exceeded the prescribed values. The results are shown in Table 1.

Comparative Example 2

A toner was obtained in the same manner as in Example 1 except that in the step of "4. Preparation of monomer composition" in Example 1, 0.3 parts of Spiron Black TRH (trade name; product of Hodogaya Chemical Co., Ltd.) were used as a negative charge control agent in place of the sulfonic group-containing copolymer ($B_1$). This toner was used to conduct evaluation as to image quality. As a result, the image density and fog values were lower than the respective prescribed values in respective continuous printing up to 5,000 sheets under high-temperature and high-humidity (H/H), 4,000 sheets under low-temperature and low-humidity (L/L) and 9,000 sheets in the durability test. However, thereafter, both values exceeded the prescribed values. The results are shown in Table 1.

TABLE 1

| | Example | | Comp. Example | |
|---|---|---|---|---|
| | 1 | 2 | 1 | 2 |
| Positive charge control resin (A) | | | | |
| Weight average molecular weight | $2.5 \times 10^4$ | $2.5 \times 10^4$ | $2.5 \times 10^4$ | $2.5 \times 10^4$ |
| % by weight of functional group | 2 | 2 | 2 | 2 |
| Amount added (part) | 2 | 2 | 2 | 2 |
| Negative charge control resin (B) | | | | |
| Weight average molecular weight | $1.6 \times 10^4$ | $1.6 \times 10^4$ | — | Spiron Black |
| % by weight of functional group | 0.5 | 0.5 | — | TRH |
| Amount added (part) | 1 | 3 | — | 2 |
| Functional ratio | 1:0.125 | 1:0.375 | — | — |

TABLE 1-continued

| | Example | | Comp. Example | |
|---|---|---|---|---|
| | 1 | 2 | 1 | 2 |
| Toner | | | | |
| Volume average particle diameter (μm) | 9.6 | 9.5 | 9.7 | 9.4 |
| Particle diameter distribution (dv/dp) | 1.31 | 1.35 | 1.33 | 1.56 |
| Spheroidicity (dl/ds) | 1.15 | 1.12 | 1.16 | 1.14 |
| Properties of toner | | | | |
| Flowability | 85 | 81 | 70 | 55 |
| Shelf stability | 2.0 | 1.5 | 2.2 | 2.6 |
| Charge level (μC/g) | | | | |
| H/H | +33 | +30 | +38 | +30 |
| N/N | +36 | +32 | +42 | +33 |
| L/L | +38 | +34 | +45 | +36 |
| Image quality Environmental dependence (sheets) | | | | |
| H/H | 13,000 | 11,000 | 5,000 | 5,000 |
| L/L | 9,000 | 11,000 | 2,000 | 4,000 |
| Durability (sheets) | 19,000 | 23,000 | 8,000 | 9,000 |

(Note)
(1) % by weight of functional group: A proportion (% by weight) of a structure unit derived from the quaternary ammonium salt group-containing methacrylate monomer in the quaternary ammonium salt group-containing copolymer (positive charge control resin) or a proportion (% by weight) of a structure unit derived from the sulfonic group-containing acrylamide monomer in the sulfonic group-containing copolymer (negative charge control resin).
(2) Parts by weight added: A proportion of the positive or negative charge control resin to 100 parts by weight of the monomer for toner.
(3) Functional ratio: A product of (% by weight of the functional group) × (the amount added) in each of the positive and negative charge control resins was calculated out to find a ratio between both products. In this case, a product of (% by weight of the functional group) × (the amount added) of the charge control resin exhibiting the same charged polarity as the toner was regarded as 1 to express the functional ratio.
(4) dv/dp: A ratio of the volume average particle diameter (dv) to the number average particle diameter (dp) of the toner particles.
(1) to (4) in the above note apply likewise even to the following tables.

Example 3

(1) Similar to the respective synthesis processes of the positive and negative charge control resins in Example 1, a quaternary ammonium salt group-containing copolymer ($A_2$) [Mw=25,000; styrene/n-butyl acrylate/N-benzyl-N,N-dimethyl-N-(2-methacryloxyethyl)ammonium chloride=85/9/6 (charged weight ratio)] and a sulfonic group-containing copolymer ($B_2$) [Mw=15,000; styrene/n-butyl acrylate/2-acrylamido-2-methylpropanesulfonic acid=88/11/1 (charged weight ratio)] were synthesized.

(2) A toner was obtained in the same manner as in Example 1 except that in the step of "4. Preparation of monomer composition" in Example 1, 2 parts of the quaternary ammonium salt group-containing copolymer ($A_2$) as a positive charge control resin and 2 parts of the sulfonic group-containing copolymer ($B_2$) as a negative charge control resin were used. This toner was used to conduct evaluation as to image quality. As a result, the image density and fog values were lower than the respective prescribed values in respective continuous printing up to 14,000 sheets under high-temperature and high-humidity (H/H), 10,000 sheets under low-temperature and low-humidity (L/L) and 19,000 sheets in the durability test. The results are shown in Table 2.

Example 4

A toner was obtained in the same manner as in Example 3 except that the amount of the sulfonic group-containing copolymer ($B_2$) used was changed from 2 parts to 5 parts. This toner was used to conduct evaluation as to image quality. As a result, the image density and fog values were lower than the respective prescribed values in respective continuous printing up to 12,000 sheets under high-temperature and high-humidity (H/H), 13,000 sheets under low-temperature and low-humidity (L/L) and 23,000 sheets in the durability test. The results are shown in Table 2.

Example 5

A toner was obtained in the same manner as in Example 3 except that the amount of the sulfonic group-containing copolymer (B2) used was changed from 2 parts to 8 parts. This toner was used to conduct evaluation as to image quality. As a result, the image density and fog values were lower than the respective prescribed values in respective continuous printing up to 10,000 sheets under high-temperature and high-humidity (H/H), 12,000 sheets under low-temperature and low-humidity (L/L) and 22,000 sheets in the durability test. The results are shown in Table 1.

Comparative Example 3

A toner was obtained in the same manner as in Example 3 except that no sulfonic group-containing copolymer ($B_2$) was used. This toner was used to conduct evaluation as to image quality. As a result, the image density and fog values were lower than the respective prescribed values in respective continuous printing up to 6,000 sheets under high-temperature and high-humidity (H/H), 2,000 sheets under low-temperature and low-humidity (L/L) and 7,000 sheets in the durability test. However, thereafter, both values exceeded the prescribed values. The results are shown in Table 2.

TABLE 2

| | Example | | | Comp. Ex |
|---|---|---|---|---|
| | 3 | 4 | 5 | 3 |
| Positive charge control resin (A) | | | | |
| Weight average molecular weight | $2.5 \times 10^4$ | $2.5 \times 10^4$ | $2.5 \times 10^4$ | $2.5 \times 10^4$ |
| % by weight of functional group | 6 | 6 | 6 | 6 |
| Amount added (part) | 2 | 2 | 2 | 2 |
| Negative charge control resin (B) | | | | |
| Weight average molecular weight | $1.5 \times 10^4$ | $1.5 \times 10^4$ | $1.5 \times 10^4$ | — |
| % by weight of functional group | 1 | 1 | 1 | — |
| Amount added (part) | 2 | 5 | 3 | — |
| Functional ratio | 1:0.167 | 1:0.42 | 1:0.67 | — |
| Toner | | | | |
| Volume average particle diameter (μm) | 9.4 | 9.7 | 9.5 | 9.6 |

TABLE 2-continued

| | Example | | | Comp. Ex |
|---|---|---|---|---|
| | 3 | 4 | 5 | 3 |
| Particle diameter distribution (dv/dp) | 1.34 | 1.36 | 1.38 | 1.40 |
| Spheroidicity (dl/ds) | 1.12 | 1.18 | 1.16 | 1.15 |
| Properties of toner | | | | |
| Flowability | 83 | 86 | 90 | 65 |
| Shelf stability | 2.6 | 3.2 | 3.0 | 6.8 |
| Charge level (μC/g) | | | | |
| H/H | +42 | +34 | +30 | +58 |
| N/N | +44 | +37 | +33 | +62 |
| L/L | +46 | +40 | +38 | +66 |
| Image quality Environmental dependence (sheets) | | | | |
| H/H | 14,000 | 12,000 | 10,000 | 6,000 |
| L/L | 10,000 | 13,000 | 12,000 | 2,000 |
| Durability (sheets) | 19,000 | 23,000 | 22,000 | 7,000 |

Example 6

(1) Similar to the respective synthesis processes of the positive and negative charge control resins in Example 1, a quaternary ammonium salt group-containing copolymer ($A_3$) [Mw=20,000; styrene/n-butyl acrylate/N-benzyl-N,N-dimethyl-N-(2-methacryloxyethyl)ammonium chloride=89/9/2 (charged weight ratio)] and a sulfonic group-containing copolymer ($B_3$) [Mw=15,000; styrene/n-butyl acrylate/2-acrylamido-2-methylpropanesulfonic acid=86/9/5 (charged weight ratio)] were synthesized.

(2) Ninety parts of styrene and 10 parts of a parting agent ("Paraflint Spray 30", trade name; produced by Schumann Sutherl Co.) were wet-ground by means of a media type wet grinding machine to prepare a styrene/parting agent dispersion having a solids content of 10%, in which the parting agent had been uniformly dispersed in styrene. The particle diameter of the parting agent in this dispersion was measured by means of SALD 2000J (manufactured by Shimadzu Corporation) and found to be 2.8 μm in terms of $D_{50}$.

(3) A toner was obtained in the same manner as in Example 1 except that in the step of "4. Preparation of monomer composition" in Example 1, 20 parts (composition: parting agent 2 parts, and styrene 18 parts) of the styrene/parting agent dispersion obtained in the step (2), 1 part of the quaternary ammonium salt group-containing copolymer ($A_3$) as a positive charge control resin and 5 parts of the sulfonic group-containing copolymer ($B_3$) as a negative charge control resin were used. This toner was used to conduct evaluation as to image quality. As a result, the image density and fog values were lower than the respective prescribed values in respective continuous printing up to 13,000 sheets under high-temperature and high-humidity (H/H), 10,000 sheets under low-temperature and low-humidity (L/L) and 20,000 sheets in the durability test. The results are shown in Table 3.

Example 7

(1) Similar to the respective synthesis processes of the positive and negative charge control resins in Example 1, a quaternary ammonium salt group-containing copolymer ($A_4$) [Mw=20,000; styrene/n-butyl acrylate/N-benzyl-N,N-dimethyl-N-(2-methacryloxyethyl)ammonium chloride=85/

10/5 (charged weight ratio)] and a sulfonic group-containing copolymer ($B_4$) [Mw=20,000; styrene/n-butyl acrylate/2-acrylamido-2-methylpropanesulfonic acid=85/5/10 (charged weight ratio)] were synthesized.

(2) A toner was obtained in the same manner as in Example 6 except that 0.5 parts of the quaternary ammonium salt group-containing copolymer ($A_4$) as a positive charge control resin and 2 parts of the sulfonic group-containing copolymer ($B_4$) as a negative charge control resin were used. This toner was used to conduct evaluation as to image quality. As a result, the image density and fog values were lower than the respective prescribed values in respective continuous printing up to 13,000 sheets under high-temperature and high-humidity (H/H), 11,000 sheets under low-temperature and low-humidity (L/L) and 21,000 sheets in the durability test. The results are shown in Table 3.

Example 8

(1) Similar to the respective synthesis processes of the positive and negative charge control resins in Example 1, a quaternary ammonium salt group-containing copolymer ($A_5$) [Mw=15,000; styrene/n-butyl acrylate/N-benzyl-N,N-dimethyl-N-(2-methacryloxyethyl)ammonium chloride=83/16.8/0.2 (charged weight ratio)] and a sulfonic group-containing copolymer ($B_5$) [Mw=20,000; styrene/n-butyl acrylate/2-acrylamido-2-methylpropanesulfonic acid=83/12/5 (charged weight ratio)] were synthesized.

(2) A toner was obtained in the same manner as in Example 6 except that 3 parts of the quaternary ammonium salt group-containing copolymer ($A_5$) as a positive charge control resin and 1 part of the sulfonic group-containing copolymer ($B_5$) as a negative charge control resin were used. This toner was used to conduct evaluation as to image quality. As a result, the image density and fog values were lower than the respective prescribed values in respective continuous printing up to 13,000 sheets under high-temperature and high-humidity (H/H), 12,000 sheets under low-temperature and low-humidity (L/L) and 23,000 sheets in the durability test. The results are shown in Table 3.

Example 9

(1) Similar to the respective synthesis processes of the positive and negative charge control resins in Example 1, a quaternary ammonium salt group-containing copolymer ($A_6$) [Mw=15,000; styrene/n-butyl acrylate/N-benzyl-N,N-dimethyl-N-(2-methacryloxyethyl)ammonium chloride=83/16.5/0.5 (charged weight ratio)] and a sulfonic group-containing copolymer ($B_6$) [Mw=10,000; styrene/n-butyl acrylate/2-acrylamido-2-methylpropanesulfonic acid 83/14/3 (charged weight ratio)] were synthesized.

(2) A toner was obtained in the same manner as in Example 6 except that 3 parts of the quaternary ammonium salt group-containing copolymer ($A_6$) as a positive charge control resin and 3 parts of the sulfonic group-containing copolymer ($B_6$) as a negative charge control resin were used. This toner was used to conduct evaluation as to image quality. As a result, the image density and fog values were lower than the respective prescribed values in respective continuous printing up to 13,000 sheets under high-temperature and high-humidity (H/H), 10,000 sheets under low-temperature and low-humidity (L/L) and 20,000 sheets in the durability test. The results are shown in Table 3.

TABLE 3

| | Example | | | |
|---|---|---|---|---|
| | 6 | 7 | 8 | 9 |
| Positive charge control resin (A): | | | | |
| Weight average molecular weight | $1.5 \times 10^4$ | $2.0 \times 10^4$ | $2.0 \times 10^4$ | $1.0 \times 10^4$ |
| % by weight of functional group | 5 | 10 | 5 | 3 |
| Amount added (part) | 5 | 2 | 1 | 3 |
| Negative charge control resin (B) | | | | |
| Weight average molecular weight | $2.0 \times 10^4$ | $2.0 \times 10^4$ | $1.5 \times 10^4$ | $1.5 \times 10^4$ |
| % by weight of functional group | 2 | 5 | 0.2 | 0.5 |
| Amount added (part) | 1 | 0.5 | 3 | 3 |
| Functional ratio | 1:0.08 | 1:0.125 | 1:0.12 | 1:0.17 |
| Toner | | | | |
| Volume average particle diameter (μm) | 7.3 | 7.5 | 7.2 | 7.5 |
| Particle diameter distribution (dv/dp) | 1.34 | 1.35 | 1.33 | 1.33 |
| Spheroidicity (dl/ds) | 1.12 | 1.14 | 1.18 | 1.17 |
| Properties of toner | | | | |
| Flowability | 87 | 88 | 88 | 90 |
| Shelf stability | 0.2 | 0.2 | 0.2 | 0.2 |
| Charge level (μC/g) | | | | |
| H/H | −50 | −42 | −26 | −24 |
| N/N | −53 | −43 | −29 | −26 |
| L/L | −55 | −47 | −31 | −29 |
| Image quality Environmental dependence (sheets) | | | | |
| H/H | 13,000 | 13,000 | 13,000 | 13,000 |
| L/L | 10,000 | 11,000 | 12,000 | 10,000 |
| Durability (sheets) | 20,000 | 21,000 | 23,000 | 20,000 |

Comparative Example 4

A toner was obtained in the same manner as in Example 6 except that no quaternary ammonium salt group-containing copolymer ($A_3$) was used. This toner was used to conduct evaluation as to image quality. As a result, the image density and fog values were lower than the respective prescribed values in respective continuous printing up to 5,000 sheets under high-temperature and high-humidity (H/H), 2,000 sheets under low-temperature and low-humidity (L/L) and 6,000 sheets in the durability test. However, thereafter, both values exceeded the prescribed values. The results are shown in Table 4.

Comparative Example 5

A toner was obtained in the same manner as in Example 6 except that 0.3 parts of Bontron NO1 (trade name; product of Orient Chemical Industries Ltd.) were used as a charge control agent in place of the quaternary ammonium salt group-containing copolymer ($A_3$). This toner was used to conduct evaluation as to image quality. As a result, the image density and fog values were lower than the respective prescribed values in respective continuous printing up to 5,000 sheets under high-temperature and high-humidity (H/H), 6,000 sheets under low-temperature and low-humidity (L/L) and 8,000 sheets in the durability test. However, thereafter, both values exceeded the prescribed values. The results are shown in Table 4.

TABLE 4

| | Comparative Example | |
|---|---|---|
| | 4 | 5 |
| Positive charge control resin (A): | | |
| Weight average molecular weight | $1.5 \times 10^4$ | $1.5 \times 10^4$ |
| % by weight of functional group | 5 | 5 |
| Amount added (part) | 5 | 5 |
| Negative charge control resin (B): | | Bontron |
| Weight average molecular weight | — | No 1 |
| % by weight of functional group | — | |
| Amount added (part) | — | 3 |
| Functional ratio | — | — |
| Toner: | | |
| Volume average particle diameter ($\mu$m) | 6.96 | 7.1 |
| Particle diameter distribution (dv/dp) | 1.34 | 1.56 |
| Spheroidicity (dl/ds) | 1.17 | 1.19 |
| Properties of toner: | | |
| Flowability | 68 | 86 |
| Shelf stability | 3.6 | 1.8 |
| Charge level ($\mu$C/g) | | |
| H/H | −37 | −32 |
| N/N | −41 | −36 |
| L/L | −45 | −40 |
| Image quality | | |
| Environmental dependence (sheets) | | |
| H/H | 5 000 | 5,000 |
| L/L | 2,000 | 6,000 |
| Durability (sheets) | 6,000 | 8,000 |

Example 10

(i) Synthesis of Quaternary Ammonium Salt Group-containing Copolymer ($A_7$) (Positive Charge Control Resin)

In 900 parts of toluene, 100 parts of a polymerizable monomer mixture composed of 88% of styrene, 10% of n-butyl acrylate and 2% of dimethylaminoethylbenzyl methacrylate chloride was caused to react at 80° C. for 8 hours in the presence of 4 parts of azobisdimethylvaleronitrile. After the reaction, toluene was distilled off under reduced pressure to obtain a quaternary ammonium salt group-containing copolymer ($A_7$) (MW=10,000).

(ii) Synthesis of Sulfonic Group-containing Copolymer ($B_7$) (Negative Charge Control Resin)

In 900 parts of toluene, 100 parts of a polymerizable monomer mixture composed of 85% of styrene, 10% of n-butyl acrylate and 5% of 2-acrylamido-2-methylpropanesulfonic acid was caused to react at 80° C. for 8 hours in the presence of 4 parts of azobisdimethylvaleronitrile. After the reaction, toluene was removed by lyophilization to obtain a sulfonic group-containing copolymer ($B_7$) (Mw=12,000).

(iii) Preparation of Polymerizable Monomer Composition for Core

A polymerizable monomer mixture (calculated Tg of the resulting copolymer=55° C.) for core composed of 80.5 parts of styrene and 19.5 parts of n-butyl acrylate, 10 parts of dipentaerythritol hexamyristate, 0.3 parts of divinylbenzene, 7 parts of carbon black ("#25B", trade name; product of Mitsubishi Kagaku Co., Ltd.), 2 parts of the quaternary ammonium salt group-containing copolymer ($A_7$), and 0.2 parts of the sulfonic group-containing copolymer ($B_7$) were stirred and mixed, and the mixture was then subjected to wet grinding by means of a media type wet grinding machine to obtain a polymerizable monomer composition (liquid mixture) for core.

(iv) Preparation of Aqueous Dispersion Medium Containing Dispersion Stabilizer An aqueous solution with 5.5 parts of sodium hydroxide dissolved in 50 parts of ion-exchanged water was gradually added to an aqueous solution with 9 parts of magnesium chloride (water-soluble polyvalent metallic salt) dissolved in 300 parts of ion-exchanged water under stirring to prepare an aqueous dispersion medium containing magnesium hydroxide colloid (colloid of hardly water-soluble metal hydroxide). The particle diameter of the colloid formed was measured by means of an SALD particle diameter distribution meter (manufactured by Shimadzu Corporation) and found to be 0.32 $\mu$m in terms of $D_{50}$ (50% cumulative value of number particle diameter distribution) and 0.62 $\mu$m in terms of $D_{90}$ (90% cumulative value of number particle diameter distribution).

(v) Preparation of Polymerizable Monomer for Shell

Two parts of methyl methacrylate (Tg of the resulting polymer=105° C.) and 100 parts of water were subjected to a finely dispersing treatment by an ultrasonic emulsifier, thereby preparing an aqueous dispersion of a polymerizable monomer for shell. The droplet diameter of droplets of the polymerizable monomer for shell was found to be 1.6 $\mu$m in terms of $D_{90}$ as determined by means of the microtrack particle diameter distribution measuring device by adding the droplets thus obtained at a concentration of 3% to a 1% aqueous solution of sodium hexametaphosphate.

(vi) Synthesis of Toner Having Core-shell Structure

The polymerizable monomer composition for core prepared in the step (iii) was poured into the colloidal dispersion of magnesium hydroxide prepared in the step (iv), and the mixture was stirred until droplets of the composition became stable. After 6 parts of t-butyl peroxy-2-ethylhexanoate ("Perbutyl O", product of Nippon Oil & Fats Co., Ltd.) was added as a polymerization initiator thereto, the resultant dispersion was stirred for 30 minutes at 21,000 rpm under high shearing force by means of a Clearmix (CLM-0.85, trade name; manufactured by M Technique Co.) to form fine droplets of the polymerizable monomer composition for core. This aqueous dispersion containing the droplets of the monomer composition thus formed was charged into a 10-liter reactor equipped with a agitating blade to initiate a polymerization reaction at 90° C. At the time a conversion into a polymer reached almost 100%, sampling was conducted to measure the volume average particle diameter of polymer particles (core particles) formed. As a result, the volume average particle diameter of the core particles was found to be 6.3 $\mu$m.

The reactor was charged with the aqueous dispersion of the polymerizable monomer for shell and a solution with 0.2 parts of 2,2'-azobis[2-methyl-N-(2-hydroxyethyl) propionamide] ("VA-086", product of Wako Pure Chemical Industries, Ltd.) as a water-soluble initiator dissolved in 65 parts of distilled water. After the polymerization was continued for 4 hours, the reaction was stopped to obtain an aqueous dispersion (pH=9.5) of polymer particles. While stirring the aqueous dispersion, sulfuric acid was added to adjust the pH to about 5.0 to conduct acid washing (at 25° C. for 10 minutes). The thus-treated dispersion was then filtered and dehydrated. After the dehydration, washing water was sprayed on the residue to conduct water washing. Thereafter, the thus-treated residue was dried for 2 days by a dryer (at 45° C.) to obtain polymer particles of a core- shell structure. The shell thickness of the polymer particles was found to be 0.02 μm from the calculation, and their volume average particle diameter was 6.3 μm.

(vii) Preparation of Non-magnetic One-component Developer

To 100 parts of the polymer particles of the core-shell structure obtained in the step (vi), were added 0.8 parts of silica ("RX-200", trade name; product of Degussa AG) having an average particle diameter of 12 nm subjected to a hydrophobicity-imparting treatment, and they were mixed by means of a Henschel mixer to prepare a non-magnetic one-component developer (toner). The evaluation of image with this toner revealed that at both high temperature and high humidity, and low temperature and low humidity, extremely good images high in image density and free of fog were obtained. This toner has a fixing temperature of 130° C. and an offset temperature of 200° C., and the fixing margin was broad and excellent. The results are shown in Table 5.

Example 11

(1) Polymer particles of a core-shell structure were prepared in the same manner as in Example 10 except that in the step of "(iii) Preparation of polymerizable monomer composition for core" in Example 10, the amount of the quaternary ammonium salt group-containing copolymer ($A_7$) added was changed from 2 parts to 1 part, and the amount of the sulfonic group-containing copolymer ($B_7$) added was changed from 0.2 parts to 2 parts.

(2) To 100 parts of the polymer particles obtained in the step (1), were added 0.3 parts of hydrophobic silica ("R-974", trade name; particle diameter: 12 nm; product of Nippon Aerosil Co., Ltd.), 0.9 parts of hydrophobic silica ("Rx-50", trade name; particle diameter: 40 nm; product of Nippon Aerosil Co., Ltd.) and 0.6 parts titanium oxide ("EC-300", trade name; particle diameter: 50 nm; product of Titan Kogyo K.K.), and they were mixed by means of a Henschel mixer to prepare a non-magnetic one-component developer (toner). A commercially available printer (12 papers per minute printer), to which a negatively charged developer is applied, was used to evaluate this toner. The results are shown in Table 5.

Comparative Example 6

A toner was obtained in the same manner as in Example 10 except that in the step of "(iii) Preparation of polymerizable monomer composition for core" in Example 10, no sulfonic group-containing copolymer ($B_7$) was used. The results are shown in Table 5.

Comparative Example 7

A toner was obtained in the same manner as in the same manner as in Example 11 except that in the step (1) in Example 11, no quaternary ammonium salt group-containing copolymer ($A_7$) was used. The results are shown in Table 5.

TABLE 5

| | Example | | Comp. Example | |
|---|---|---|---|---|
| | 10 | 11 | 6 | 7 |
| Positive charge control resin (A) | | | | |
| Weight average molecular weight | $1.0 \times 10^4$ | $1.0 \times 10^4$ | $1.0 \times 10^4$ | — |
| % by weight of functional group | 2 | 2 | 2 | — |
| Amount added (part) | 2 | 1 | 2 | — |
| Negative charge control resin (B) | | | | |
| Weight average molecular weight | $1.2 \times 10^4$ | $1.2 \times 10^4$ | — | $1.2 \times 10^4$ |
| % by weight of functional group | 5 | 5 | — | 5 |
| Amount added (part) | 0.2 | 2 | — | 2 |
| Functional ratio | 1:0.25 | 1:0.20 | — | — |
| Toner | | | | |
| Volume average particle diameter (μm) | 6.3 | 6.5 | 6.7 | 6.4 |
| Shell thickness (μm) | 0.02 | 0.02 | 0.02 | 0.02 |
| Particle diameter distribution (dv/dp) | 1.26 | 1.22 | 1.28 | 1.26 |
| Spheroidicity (dl/ds) | 1.12 | 1.14 | 1.17 | 1.19 |
| Standard deviation of number particle diameter distribution | 1.4 | 1.6 | 2.0 | 1.9 |
| Properties of toner | | | | |
| Flowability | 75 | 72 | 70 | 68 |
| Shelf stability | 2.0 | 3.0 | 4.0 | 3.0 |
| Fixing temperature (° C.) | 130 | 120 | 160 | 150 |
| Offset temperature (° C.) | 200 | 200 | 220 | 220 |
| Resolution | ○ | ○ | x | x |
| Charge level (μC/g) | | | | |
| H/H | +33 | −30 | +38 | −30 |
| N/N | +36 | −32 | +42 | −33 |
| L/L | +38 | −34 | +45 | −36 |
| Image quality | | | | |
| Environmental dependence (sheets) | | | | |
| H/H | 13,000 | 12,000 | 8,000 | 5,000 |
| ID | 1.44 | 1.48 | 1.46 | 1.48 |
| Fog | 6.2 | 7.6 | 8.0 | 8.2 |
| L/L | 11,000 | 10,000 | 6,000 | 7,000 |
| ID | 1.40 | 1.42 | 1.22 | 1.26 |
| Fog | 4.2 | 5.2 | 3.4 | 3.6 |
| Durability (sheets) | 20,000 | 20,000 | 6,000 | 6,000 |

INDUSTRIAL APPLICABILITY

According to the present invention, there are provided toners for development of electrostatic images, which are sharp in particle diameter distribution and excellent in flowability and shelf stability, scarcely changed even in charge level in both environments of low-temperature and low-humidity, and high-temperature and high-humidity, and scarcely observed deteriorating image quality even when conducting continuous printing on a number of paper sheets. According to the present invention, there are also provided toners for development of electrostatic images, which can meat the lowering of a fixing temperature, the speeding-up of printing, the formation of full-color images, and the like and exhibit high resolution. The toners according to the present invention can be suitably used in printers and copying machines of the non-magnetic one-component development system.

What is claimed is:

1. A toner for development of electrostatic images, comprising at least a binder resin, a colorant and a charge control agent, wherein the charge control agent contains a positive charge control resin (A) composed of a polymer having a weight average molecular weight of 1,000 to 100,000 and a functional group which brings positively charging ability, and a negative charge control resin (B) composed of a polymer having a weight average molecular weight of 1,000 to 100,000 and a functional group which brings negatively charging ability.

2. The toner for development of electrostatic images according to claim 1, which has a core-shell structure that a coating layer formed of a resin having a glass transition temperature higher than the glass transition temperature of the binder resin is formed on each surface of colored particles containing at least the binder resin, colorant and charge control agent.

3. The toner for development of electrostatic images according to claim 1, wherein the positive charge control resin (A) is a polymer having a pyridinium group, amino group or quaternary ammonium salt group as the functional group which brings the positively charging ability.

4. The toner for development of electrostatic images according to claim 3, wherein the quaternary ammonium salt group is a group represented by the formula:

$$-NR_3^+.X^-$$

wherein 3 Rs are, independently of one another, a hydrogen atom or an alkyl group, and X is a halogen atom, a halogenated alkyl group or a hydrocarbon group having $-SO_3^-$, $-PO_3^-$ or $-BO_3^-$.

5. The toner for development of electrostatic images according to claim 1, wherein the positive charge control resin (A) is a copolymer containing a monomer unit having a functional group which brings positively charging ability, a vinyl aromatic hydrocarbon monomer unit and a (meth) acrylate monomer unit.

6. The toner for development of electrostatic images according to claim 5, wherein the monomer unit having a functional group which brings positively charging ability is a quaternary ammonium salt group-containing (meth) acrylate monomer unit represented by the formula (I):

[I]

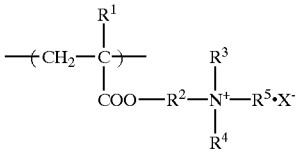

wherein $R^1$ is a hydrogen atom or a methyl group, $R^2$ is a linear or branched alkylene group which may be substituted by a halogen and has 1 to 3 carbon atoms, $R^3$ to $R^5$ are, independently of one another, a hydrogen atom or a linear, branched or cyclic alkyl group having 1 to 6 carbon atoms, and X is a halogen atom, or benzene or naphthalene which may have a linear, branched or cyclic alkyl group having 1 to 6 carbon atoms or a halogen atom and has any of $-SO_3^-$, $-PO_3^-$ and $-BO_3^-$.

7. The toner for development of electrostatic images according to claim 6, wherein the quaternary ammonium salt group-containing (meth)acrylate monomer unit is a structure unit derived from a quaternary ammonium salt group-containing (meth)acrylate monomer selected from the group consisting of N,N,N-trimethyl-N-(2-methacryloxyethyl) ammonium chloride and N-benzyl-N,N-dimethyl-N-(2-methacryloxyethyl)ammonium chloride.

8. The toner for development of electrostatic images according to claim 5, wherein the positive charge control resin (A) is a copolymer comprising 0.1 to 15% by weight of the monomer unit having the functional group which brings positively charging ability.

9. The toner for development of electrostatic images according to claim 1, wherein the negative charge control resin (B) is a polymer having a maleic anhydride group, carboxyl group, sulfuric acid residue, sulfonic group or phosphoric group as the functional group which brings negatively charging ability.

10. The toner for developmnt of electrostatic images according to claim 1, wherein the negative charge control resin (B) is a copolymer containing a vinyl monomer unit having a functional group which brings negatively charging ability, a vinyl aromatic hydrocarbon monomer unit and a (meth) acrylate monomer unit.

11. The toner for development of electrostatic images according to claim 10, wherein the vinyl monomer unit having a functional group which brings negatively charging ability is a sulfonic group-containing (meth)acrylamide monomer unit.

12. The toner for development of electrostatic images according to claim 11, wherein the sulfonic group-containing (meth)acrylamide monomer unit is a structure unit derived from a sulfonic group-containing (meth) acrylamide monomer selected from the group consisting of acrylamidoalkylsulfonic acids, acrylamidocarboxyalkylsulfonic acids, acrylamidoheterocyclic group-containing alkylsulfonic acids, and metal salts thereof.

13. The toner for development of electrostatic images according to claim 10, wherein the negative charge control resin (B) is a copolymer comprising 0.1 to 15% by weight of the monomer unit having the functional group which brings negatively charging ability.

14. The toner for development of electrostatic images according to claim 1, which has positively charging ability, in which a functional ratio (A:B) of the positive charge control resin (A) to the negative charge control resin (B) is 1:0.005 to 1:0.9.

15. The toner for development of electrostatic images according to claim 1, which has negatively charging ability, in which a functional ratio (B:A) of the negative charge control resin (B) to the positive charge control resin (A) is 1:0.005 to 1:0.9.

16. The toner for development of electrostatic images according to claim 1, wherein the total content of the positive charge control resin (A) and the negative charge control resin (B) is 0.01 to 15 parts by weight per 100 parts by weight of the binder resin.

17. The toner for development of electrostatic images according to claim 1, which has a volume average particle diameter of 1 to 12 μm, a particle diameter distribution (volume average particle diameter/number average particle diameter) of at most 1.7 and a spheroidicity of 1.0 to 1.3.

18. The toner for development of electrostatic images according to claim 1, which has a standard deviation of a number average particle diameter distribution of at most 1.8.

19. A process for producing a toner for development of electrostatic images comprising the step of subjecting a monomer composition containing at least a polymerizable monomer, a colorant and a charge control agent to suspension polymerization in an aqueous dispersion medium containing a dispersion stabilizer to form polymer particles, the process comprising using, as the charge control agent, a positive charge control resin (A) composed of a polymer having a weight average molecular weight of 1,000 to 100,000 and a functional group which brings positively charging ability, and a negative charge control resin (B) composed of a polymer having a weight average molecular weight of 1,000 to 100,000 and a functional group which brings negatively charging ability, in combination.

20. A process for producing a toner for development of electrostatic images comprising the steps of (I) subjecting a monomer composition containing at least a polymerizable monomer, a colorant and a charge control agent to suspension polymerization in an aqueous dispersion medium containing a dispersion stabilizer, thereby forming core polymer particles, and (II) polymerizing a polymerizable monomer for shell, which is capable of forming a polymer having a glass transition temperature higher than the glass transition temperature of a polymer component forming the core polymer particles, in the presence of the core polymer particles to form polymer particles of a core-shell structure having a shell polymer layer which covers each of the core polymer particles, the process comprising using, as the charge control agent, a positive charge control resin (A) composed of a polymer having a weight average molecular weight of 1,000 to 100,000 and a functional group which brings positively charging ability, and a negative charge control resin (B) composed of a polymer having a weight average molecular weight of 1,000 to 100,000 and a functional group which brings negatively charging ability, in combination.

* * * * *